United States Patent [19]

Wilkes et al.

[11] Patent Number: 4,934,029

[45] Date of Patent: Jun. 19, 1990

[54] APPARATUS AND METHOD FOR REMOVING A FIBER FRACTION FROM SEED COTTON

[75] Inventors: Lambert H. Wilkes, College Station; Kenneth E. Watkins, Bryan, both of Tex.; William F. Lalor, Raleigh, N.C.; Martin Mehner, College Station, Tex.

[73] Assignee: Cotton Incorporated, New York, N.Y.

[21] Appl. No.: 343,436

[22] Filed: Apr. 26, 1989

[51] Int. Cl.[5] ..... D01B 1/06

[52] U.S. Cl. ..... 19/48 R; 19/39; 19/64.5

[58] Field of Search ..... 19/39–54, 19/58, 59, 64.5

[56] References Cited

U.S. PATENT DOCUMENTS

| | | | |
|---|---|---|---|
| 454,146 | 6/1891 | Thomas et al. | 19/64.5 |
| 509,759 | 11/1893 | Munger | 19/64.5 |
| 633,994 | 10/1899 | Graves | 19/50 |
| 653,525 | 7/1900 | Parker | 19/64.5 |
| 841,385 | 1/1907 | Fordyce | 19/53 |
| 3,218,674 | 11/1965 | Cunningham | 19/50 |
| 3,352,159 | 11/1967 | Bruce et al. | 73/422 |
| 3,408,697 | 11/1968 | Craig | 19/156.3 |
| 3,435,484 | 4/1969 | Langdon | 19/65 |
| 3,728,759 | 4/1973 | Hergeth | 19/105 |
| 3,750,235 | 8/1973 | Wise | 19/105 |
| 3,762,144 | 10/1973 | Didek et al. | 57/58.91 |
| 3,769,658 | 11/1973 | Brooks | 19/64.5 |
| 4,070,811 | 1/1978 | Fehrer | 57/50 |
| 4,126,913 | 11/1978 | Roberson | 19/96 |
| 4,202,163 | 5/1980 | Turk et al. | 57/58.95 |
| 4,262,390 | 4/1981 | Einglett et al. | 19/50 |
| 4,441,232 | 4/1984 | Underbrink et al. | 19/48 R |
| 4,458,381 | 7/1984 | Van Doorn et al. | 19/64.5 |
| 4,462,140 | 7/1984 | Wood | 19/105 |
| 4,470,172 | 9/1984 | Leifeld | 19/202 |
| 4,471,607 | 9/1984 | Schmolke | 57/408 |
| 4,499,633 | 2/1985 | Trutzschler | 19/105 |
| 4,520,530 | 6/1985 | Pinto | 19/105 |
| 4,606,177 | 8/1986 | Schleuter | 56/30 |
| 4,697,309 | 10/1987 | Rudolph | 19/105 |
| 4,700,431 | 10/1987 | Artzt et al. | 19/105 |
| 4,734,957 | 4/1988 | Lenzen | 19/105 |

FOREIGN PATENT DOCUMENTS

| | | |
|---|---|---|
| 545704 | 3/1977 | U.S.S.R. . |
| 1383375 | 2/1975 | United Kingdom . |

*Primary Examiner*—Andrew M. Falik
*Assistant Examiner*—Michael A. Neas
*Attorney, Agent, or Firm*—Burns, Doane, Swecker & Mathis

[57] ABSTRACT

An apparatus for removing a fiber fraction from seed cotton includes a plurality of freely rotatable cage rollers that are arranged substantially parallel to one another. The plurality of rollers are rotatable in a continuous path that has a first side for receiving seed cotton. The outer peripheral surface of at least one nip roller is positioned in abutting relation to the cage rollers on a second side of the continuous path to thereby apply a force to the cage rollers. An arrangement is also provided for separating the seed cotton into individual locks before the seed cotton is fed onto the first side of the continuous path. Further, an arrangement can be attached to the at least one nip roller for varying the force applied by the nip roller to the cage roller.

52 Claims, 8 Drawing Sheets

APPARATUS AND METHOD FOR REMOVING A FIBER FRACTION FROM SEED COTTON

BACKGROUND OF THE INVENTION

The present invention relates to an apparatus and method for processing seed cotton. More particularly, the present invention relates to an apparatus and method for removing a fiber fraction from seed cotton.

Various devices have been proposed for ginning seed cotton. It is highly desirable when operating a gin apparatus that the performance and capacity of the gin apparatus be maximized. The performance of the ginning apparatus may be evaluated in terms of the percent of lint removed from the seed cotton while the capacity of the gin apparatus may be evaluated in terms of the amount of seed cotton that is processed in a given amount of time.

In one type of ginning apparatus described in U.S. Pat. No. 4,441,232 which is assigned to the assignee herein, a plurality of cage rollers are rotatably driven in a continuous path. A nip roller is positioned in abutting relation to the cage rollers on the side of the continuous path opposite to the side that receives the seed cotton. A suction source draws air through the cage rollers and thus tends to draw at least a portion of the fiber fraction from the seed cotton through the cage rollers. The seed cotton moves in conjunction with the cage rollers as the cage rollers move in their continuous path and the fiber fraction drawn in by the suction is nipped by the nip roller and removed from the apparatus through the suction duct.

While that apparatus is effective in removing a large portion of the fiber fraction from the seed cotton, the apparatus is susceptible of improvements. During operation of that ginning apparatus, the locks of seed cotton that are fed to the cage rollers tend to bunch-up and fall on top of one another when they reach the cage rollers. As a consequence, the locks of cotton which are not in direct contact with the cage rollers but which lie on top of other locks of seed cotton are not subjected to the air suction nor are they subjected to the nipping action of the nip rollers during the ginning process. Thus, a portion of the seed cotton remains unginned after passing through the ginning apparatus.

OBJECTS AND SUMMARY OF THE DISCLOSURE

Applicants have determined that the tendency of the locks of seed cotton to bunch-up and fall on top of one another as they reach the cage rollers can adversely affect the performance of the ginning apparatus as well as the capacity of the ginning apparatus. Applicants have also discovered that the performance and capacity of the ginning apparatus can be improved by ensuring that the locks of seed cotton are separated into individual locks and uniformly distributed on the ginning surface of the ginning apparatus.

In view of that recognition, there exists a need in the cotton industry for a ginning apparatus that can uniformly distribute the seed cotton onto the ginning surface of the apparatus so that the performance and capacity of the apparatus can be maximized.

Accordingly, it is an object of the present invention to provide an apparatus and method for removing a fiber fraction from seed cotton that increases the capacity and performance of the ginning apparatus.

It is a further object of the present invention to provide an apparatus and method for removing a fiber fraction from seed cotton that separates the seed cotton into individual locks before the seed cotton reaches the ginning apparatus to thereby provide uniform distribution of the seed cotton on the ginning apparatus.

It is also highly desirable that the force applied by the nip rollers to the cage rollers be variable so that the length of the cotton fibers removed from the seed cotton can be selected as desired.

Accordingly, it is also an object of the present invention to provide an apparatus for removing a fiber fraction from seed cotton that permits the length of the cotton fibers removed from the seed cotton to be selected as desired.

Those and other objects are accomplished by a method and apparatus according to the present invention. The apparatus includes a plurality of freely rotatable cage rollers arranged substantially parallel to one another. The plurality of cage rollers are adapted to be rotated in a continuous path and the continuous path has a first side for receiving seed cotton and a second side opposite the first side. At least one rotatable nip roller is also provided. The nip roller has an outer peripheral surface that is positioned in abutting relation to the cage rollers on the second side of the continuous path to apply a force to the cage rollers. The apparatus further includes an arrangement for separating individual locks of the seed cotton before the seed cotton is fed onto the first side of the continuous path.

In one embodiment of the present invention, the arrangement for separating the individual locks of seed cotton includes a first duct through which an air stream flows and a second duct through which the seed cotton is fed. The second duct intersects the first duct and the first duct includes an arrangement positioned at a point along its length prior to the intersection of the first and second ducts for increasing the velocity and decreasing the pressure of the air stream in the first duct.

In another embodiment, the arrangement for separating the individual locks of seed cotton includes an inclined feed apron having a first side for receiving the seed cotton and a second side opposite the first side. The feed apron has a plurality of adjustable louvers through which an air stream from the second side of the feed apron flows.

In a further embodiment, the arrangement for separating the individual locks of seed cotton includes an inclined feed apron having a first side for receiving the seed cotton and a second side opposite the first side. The feed apron has at least one slot extending along at least a substantial portion of the width of the feed apron through which an adjustable air stream from the second side of the feed apron flows.

An additional embodiment of the arrangement for separating the individual locks of seed cotton includes two fluted rolls and two spiked tooth cylinders positioned below the fluted rolls. The fluted rolls are rotatably driven in opposite directions while the spiked tooth cylinders are rotatably driven in the same direction. The fluted rolls and the spiked tooth cylinders are arranged with respect to the first side of the continuous path such that the seed cotton is fed from the fluted rolls to the spiked tooth cylinders and directly to the first side of the continuous path without contacting any surface other than the fluted rolls and the spiked tooth cylinders.

A still further embodiment of the arrangement for separating the individual locks of seed cotton includes a hopper bin into which the seed cotton is fed and two spiked tooth cylinders positioned below the hopper bin for feeding the seed cotton directly to the cage rollers. A high friction conveyor belt is positioned in opposing relation to a side wall of the hopper so that seed cotton in the hopper bin is pressed between the high friction conveyor belt and the side wall. The two spiked tooth cylinders are positioned with respect to the hopper bin so that separate locks of seed cotton can be pulled from the hopper bin by one of the spiked tooth cylinders and then conveyed to the other spiked tooth cylinder and eventually conveyed to the first side of the continuous path.

Another embodiment of the arrangement for separating the seed cotton into individual locks and for inhibiting the seed cotton from becoming bunched-up includes a rotatable cleaning saw cylinder arranged adjacent to a doffer brush within a housing. Seed cotton that is fed into the housing reaches the cleaning saw cylinder and is held to the exterior surface of the cleaning saw cylinder. The doffer brush is positioned to brush off or pull the seed cotton from the exterior surface of the cleaning saw cylinder and the doffer brush directs the seed cotton directly to the surface of the cage rollers without contacting any other surface.

An embodiment of the present invention for varying the force applied by the nip rollers to the cage rollers includes at least one fluid operated cylinder attached to the at least one nip roller and a pressure source connected to the cylinder. An arrangement is provided for regulating the fluid pressure supplied to the cylinder to vary the force applied by the at least one nip roller to the cage rollers.

A method for removing a fiber fraction from seed cotton according to the present invention includes feeding an air stream into a first duct and feeding seed cotton into a second duct that intersects the first duct. Before the air stream reaches the point where the first duct intersects the second duct, the velocity of the air stream is increased while the pressure of the air stream is reduced. The seed cotton is then directed into the air stream of increased velocity and decreased pressure to separate the seed cotton into individual locks. Thereafter, the separated locks of seed cotton are conveyed to a cage roller apparatus that removes a fiber fraction from the seed cotton.

A method for removing a fiber fraction from seed cotton according to another embodiment of the present invention includes feeding seed cotton onto a first side of an inclined feed apron that directs the seed cotton to a cage roller apparatus for removing a fiber fraction from the seed cotton, and directing an air stream through adjustable louvers on the feed apron from a second side of the feed apron. The seed cotton is then passed over the adjustable louvers on the feed apron to thereby separate the seed cotton into individual locks as a result of the air stream flowing through the adjustable louvers. The separated locks of seed cotton are then directed by the air stream to the cage roller apparatus for removing a fiber fraction from the seed cotton.

According to another embodiment of the present invention, a method for removing a fiber fraction from seed cotton includes feeding seed cotton onto a first side of an inclined feed apron that directs the seed cotton to a cage roller apparatus for removing a fiber fraction from the seed cotton, and directing an air stream through at least one slot in the feed apron from a second side of the feed apron. The seed cotton is then passed over the at least one slot in the feed apron to thereby separate the seed cotton into individual locks as a result of the air stream flowing through the slot in the feed apron. The separated locks of seed cotton are then directed by the air stream to the cage roller apparatus for removing a fiber fraction from the seed cotton.

A method for removing a fiber fraction from seed cotton according to another embodiment of the present invention includes feeding seed cotton to two fluted rolls that rotate in opposite directions, directing the seed cotton directly from the fluted rolls to two spiked tooth cylinders that rotate in the same direction and directing the seed cotton directly from the spiked tooth cylinders to a cage roller apparatus for removing a fiber fraction from the seed cotton without contacting any surface other than the fluted rolls and the spiked tooth cylinders.

Another method for removing a fiber fraction from seed cotton according to the present invention includes feeding seed cotton to a rotating cleaning saw cylinder having an exterior surface that is adapted to aggressively hold the seed cotton, brushing the seed cotton from the exterior surface of the rotating cylinder by contacting the exterior surface of the rotating cylinder with a rotating doffer brush and directing the seed cotton directly from the doffer brush to a cage roller apparatus for removing a fiber fraction from the seed cotton without touching any surface other than the doffer brush.

A further method for removing a fiber fraction from seed cotton according to the present invention includes feeding seed cotton into a hopper bin, pressing the seed cotton between a wall of the hopper bin and a high friction conveyor belt positioned in opposing relation to the side wall, pulling separate locks of seed cotton from the somewhat pressed mass of seed cotton and directing the separated locks of seed cotton directly to a cage roller apparatus for removing a fiber fraction from the seed cotton without contacting any surface other than the spiked tooth cylinders.

BRIEF DESCRIPTION OF THE DRAWINGS

Preferred embodiments of the present invention will be described in greater detail with reference to the accompanying drawings, wherein like structures bear like reference numerals and wherein.

DETAILED DESCRIPTION OF THE PREFERRED EMBODIMENTS

Figure 1:
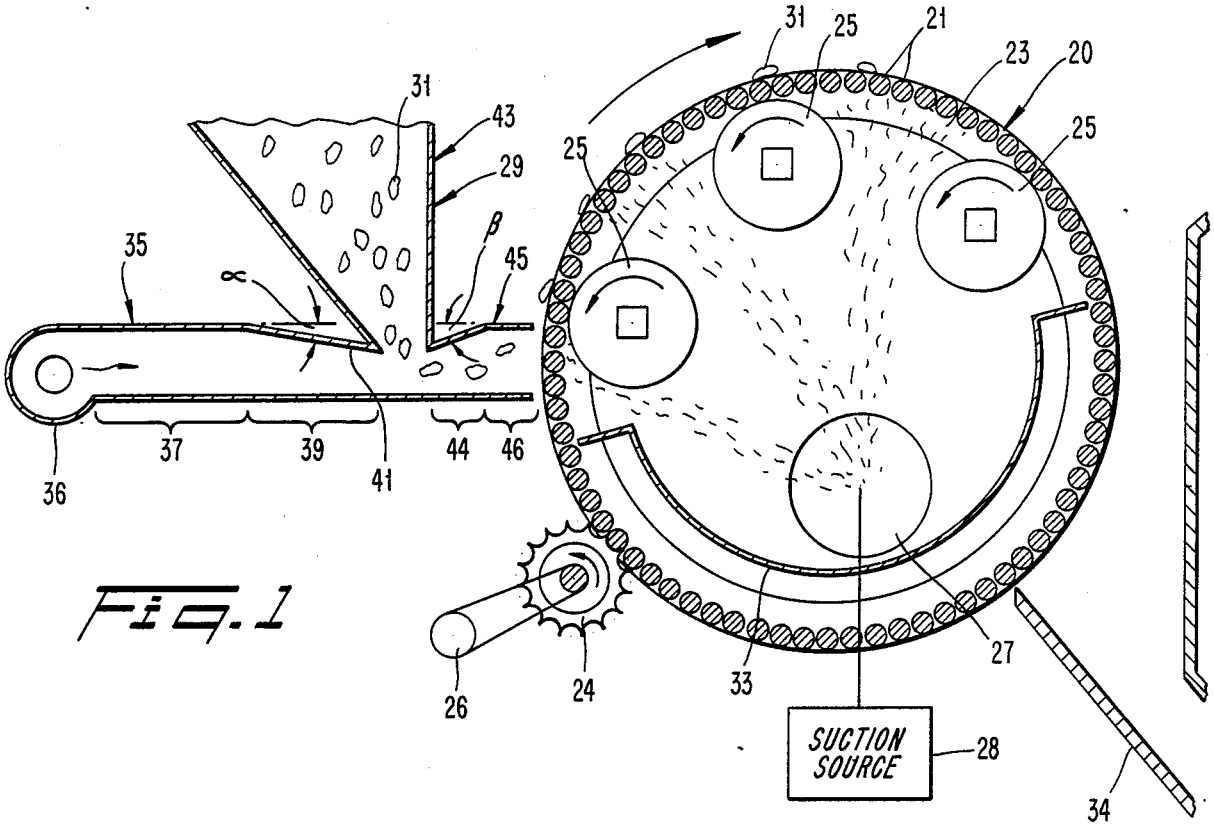
FIG. 1 is a cross-sectional view of a first embodiment of an apparatus according to the present invention, including a two duct arrangement for separating the locks of seed cotton.

With reference to FIG. 1, a first embodiment of an apparatus for removing a fiber fraction from seed cotton includes a cage roller apparatus 20 having a plurality of freely rotatable cage rollers 21 that define a continuous circular path perpendicular to the axes of the rollers 21. The cage rollers 21 are arranged in a closely spaced relationship with respect to one another. The cage rollers 21 are mounted on the periphery of a cage 23 and are mounted in a manner such that a small space is maintained between adjacent cage rollers 21.

The cage 23 and the cage rollers 21 are rotated about a longitudinal axis by any suitable device such as a toothed wheel 24 that contacts successive cage rollers 21. The toothed wheel 24 is driven by a suitable driving device 26.

At least one nip roller 25 is positioned within the cage 23. Although FIG. 1 and the other figures depict three nip rollers 25, any desired number of nip rollers may be provided. Each of the nip rollers 25 has a diameter that is relatively large in comparison to the diameter of each of the cage rollers 21. The outer cylindrical peripheral surface of each of the nip rollers 25 abuts a lower side of the continuous path formed by the plurality of cage rollers 21. In that way, the nip rollers 25 exert a force against the cage rollers 21.

A duct 27 that is connected to a suitable source of suction 28 is also positioned within the cage 23. The suction source causes a substantially constant quantity of air to be drawn from outside the cage 23. The suction source draws air radially inward between the cage rollers 21 and thus, creates a force on the outside surface of the cage rollers 21 that tends to hold objects to the surface of the cage rollers 21.

In operation, seed cotton 31 is deposited on a first, outer surface of the cage 23 against the cage rollers 21. The seed cotton 31 is held against the first outer surface of the cage rollers 21 by the suction pressure developed on the inside of the cage rollers 21 via the duct 27. The suction force acting on the seed cotton 31 tends to draw at least a portion of the fiber fraction contained in the seed cotton 31 between adjacent cage rollers 21. As the seed cotton 31 moves along with the rotating cage 23, the fiber fraction extending between adjacent cage rollers 21 is nipped by the first nip roller 25 such that the extended fiber fraction is removed from the seed cotton 3!. The spacing between adjacent cage rollers 21 is less than the diameter of the seeds and thus, the fiber fraction can be easily separated from the seed without also pulling the seed through the cage rollers 21. The separated fiber fraction is conveyed by the suction pressure developed within the duct 27 and is removed from the apparatus through the duct 27.

After passing the first nip roller 25, the seed cotton continues moving with the cage 23 and a further fiber fraction may be drawn between adjacent cage rollers 21 as a result of the suction pressure developed in the duct 27. As the seed cotton 31 progresses further around with the cage 23, the extracted fiber fraction will be nipped by the next nip roller 25 and removed from the apparatus through the duct 27.

The seed cotton 31 will continue moving with the cage 23 whereupon another fiber fraction may be drawn between adjacent cage rollers 21 and thereafter, nipped by the next nip roller 25. After passing the last nip roller 25, the seed cotton will be at a position where a tangent to the cage 23 is substantially vertical. At that point, the seed cotton 31 will fall away from the cage rollers 21 due to the force of gravity as well as the presence of an isolation flange 33 which prevents the suction pressure from holding the seed cotton to the cage rollers 21. A suitable collection device 34 can be provided for collecting the seed cotton as it falls away from the cage rollers 21.

An apparatus and method for removing a fiber fraction from seed cotton of the type described above are disclosed in U.S. Pat. No. 4,441,232, the disclosure of which is hereby incorporated by reference.

Turning once again to FIG. 1, the apparatus according to the present invention includes the cage roller apparatus 20 and a feeding arrangement 29 which separates the seed cotton into individual locks before the seed cotton reaches the cage rollers 21. In the FIG. 1 embodiment, the feeding arrangement 29 includes a first duct 35 through which an air stream is fed. The air that is fed into the first duct 35 can be supplied from any suitable source 36 such as a fan or a compressed air generator. The first duct 35 may include a first portion 37 that has a rectangular cross-section of substantially constant size and a second portion 39 that has a rectangular cross-section of varying size. One or more of the side walls 41 of the second portion 39 of the first duct 35 may be inclined so that the cross-sectional area of the second portion 39 continually decreases in a direction away from the first portion 37.

The feeding arrangement 29 of FIG. 1 further includes a second duct 43 for receiving seed cotton 31. The seed cotton 31 can be fed into the second duct 43 directly from a seed cotton cleaner (not shown) or some type of storage apparatus (not shown).

The second duct 43 intersects the first duct 35 so that seed cotton 31 in the second duct 43, will fall into the path of the stream of air flowing through the first duct 35. As can be seen from FIG. 1, the second portion 39 of the first duct is positioned between the first portion 37 of the first duct 35 and the point of intersection between the first duct 35 and the second duct 43.

As a result of the narrowing cross-section of the second portion 39 of the first duct 35, the velocity of the air stream in the first duct 35 and at the point where the air stream exits the first duct 35 is increased while the pressure of the air stream in the first duct 35 and at the exit point of the first duct 35 is decreased. Moreover, the velocity of the air stream progressively increases and the pressure of the air stream progressively decreases as the air moves along the second portion 39 of the first duct 35 from the point of largest cross-sectional area to the point of smallest cross-sectional area.

The increased velocity and decreased pressure of the air stream as it exits the first duct 35 is advantageous in several respects. First, the increased velocity of the air stream tends to act rather aggressively on the locks of seed cotton 31 that exit the second duct 43 and fall into the path of the air stream. Those locks of seed cotton that are bunched up as a result of the fibers of one lock of seed cotton becoming entangled with the fibers of other locks of seed cotton and those locks of seed cotton lying on top of one another but not necessarily having entangled fibers are separated by the force of the air stream whose velocity is increased. The separated locks of seed cotton 31 are then fed by the air stream to the cage rollers 21 for removing a fiber fraction from the seed cotton. Thus, seed cotton that would normally be fed onto the cage rollers 21 in clumps due to the bunching and piling of the seed cotton is capable of being uniformly distributed on the cage rollers 21 as a result of the fact that the seed cotton reaches the cage roller apparatus 20 in the form of individual locks of seed cotton.

A second advantage associated with the use of a first duct 35 that is capable of producing an air stream of increased velocity and decreased pressure is that the decreased pressure of the air stream permits the seed cotton to more easily fall into the air stream from the first duct 35. Thus, to a certain extent, the reduced pressure of the air stream helps ensure that seed cotton will continually be fed to the cage rollers 21. Depending upon the amount by which the pressure of the air stream is decreased, the seed cotton may actually be pulled into the path of the air stream by the decreased pressure of the air stream from the first duct 35. That pulling action may help contribute to the separation of the locks of seed cotton.

The separated locks of seed cotton can be fed to the cage rollers 21 through a third duct 45 that extends from the exit ports of the first and second ducts 35, 43 toward the cage rollers 21. Alternatively, the separated seed cotton can be fed to the cage rollers 21 directly from the point of intersection of the exit ports of the first duct 35 and the second duct 43.

Figure 2:
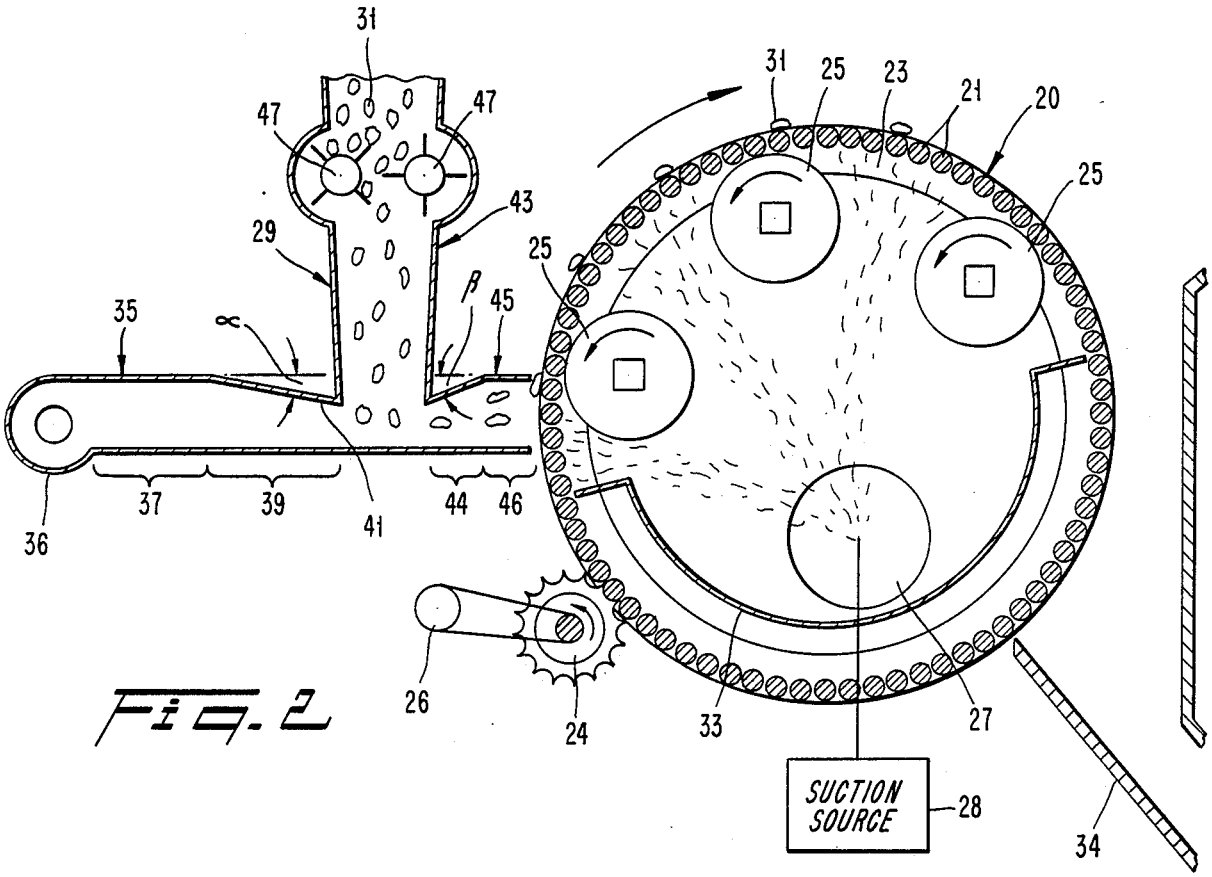
FIG. 2 is a cross-sectional view of a second embodiment of an apparatus according to the present invention, including a slightly modified two duct arrangement for separating the locks of seed cotton.

In FIG. 2, a second embodiment of the feeding arrangement 29 for separating the seed cotton 31 into individual locks is illustrated. The feeding arrangement 29 shown in FIG. 2 is similar to the feeding arrangement 29 depicted in the FIG. 1 embodiment except that in the FIG. 2 embodiment, the second duct 43 includes two fluted rolls 47 for controlling the feed rate of the seed cotton 31 to the point where the seed cotton 31 intersects the path of the air stream. The two fluted rolls 47 are substantially parallel to one another and rotate in opposite directions to force the seed cotton between the two rolls 47.

Although the first ducts 35 of the feeding arrangements 29 described above with reference to FIGS. 1 and 2 are described as being rectangular in cross-section, it should be understood that the first duct 35 could have other cross-sectional configurations. The important feature is that the cross-sectional area of a portion of the first duct 35 be reduced so that the velocity of the air stream in the first duct 35 and at the point where the air stream exits the first duct 35 is increased while the pressure is decreased.

The amount by which the second portion 39 of the first duct 35 is narrowed in the FIG. 1 and 2 embodiments may be varied, depending upon the amount of increase in velocity of the air stream and the amount of decrease in pressure of the air stream sought. It has been found desirable to narrow the second portion 39 of the first duct 35 so that the angle o illustrated in FIGS. 1 and 2 is approximately fifteen degrees and so that air velocities of approximately ten thousand feet per minute can be obtained.

With respect to the embodiments illustrated in FIGS. 1 and 2, it is to be noted that when the feeding arrangement 29 includes a third duct 45 for transporting the separated locks of seed cotton 31 to the surface of the cage rollers 21, the third duct 45 should preferably include a first portion 44 and a second portion 46. The point where the first portion 44 of the first duct 45 intersects the second duct 43 may be of the same size, i.e., have the same cross-sectional area, as the point where the second portion 39 of the first duct 35 intersects the second duct 43. In that way, the high velocity and low pressure of the air stream can, to a certain extent, be maintained as it enters the third duct 45. The first portion 44 of the third duct 45 may increase in cross-sectional area from the point where it intersects the second duct 43 to the point where it intersects the second portion 46 of the third duct 45. It has been found desirable to increase the cross-sectional area of the first portion 44 of the third duct at a rate which substantially corresponds to the rate at which second portion 39 of the first duct 35 is narrowed. Thus, it is preferable that the angle $\beta$ illustrated in FIGS. 1 and 2 be approximately 15 degrees.

The second portion 46 of the third duct 45 may be of constant cross-sectional area so that the velocity of the air stream as it reaches the surface of the cage rollers 21 is maintained at a substantially constant level that is sufficient to convey the seed cotton onto the surface of the cage rollers 21.

Figure 3:
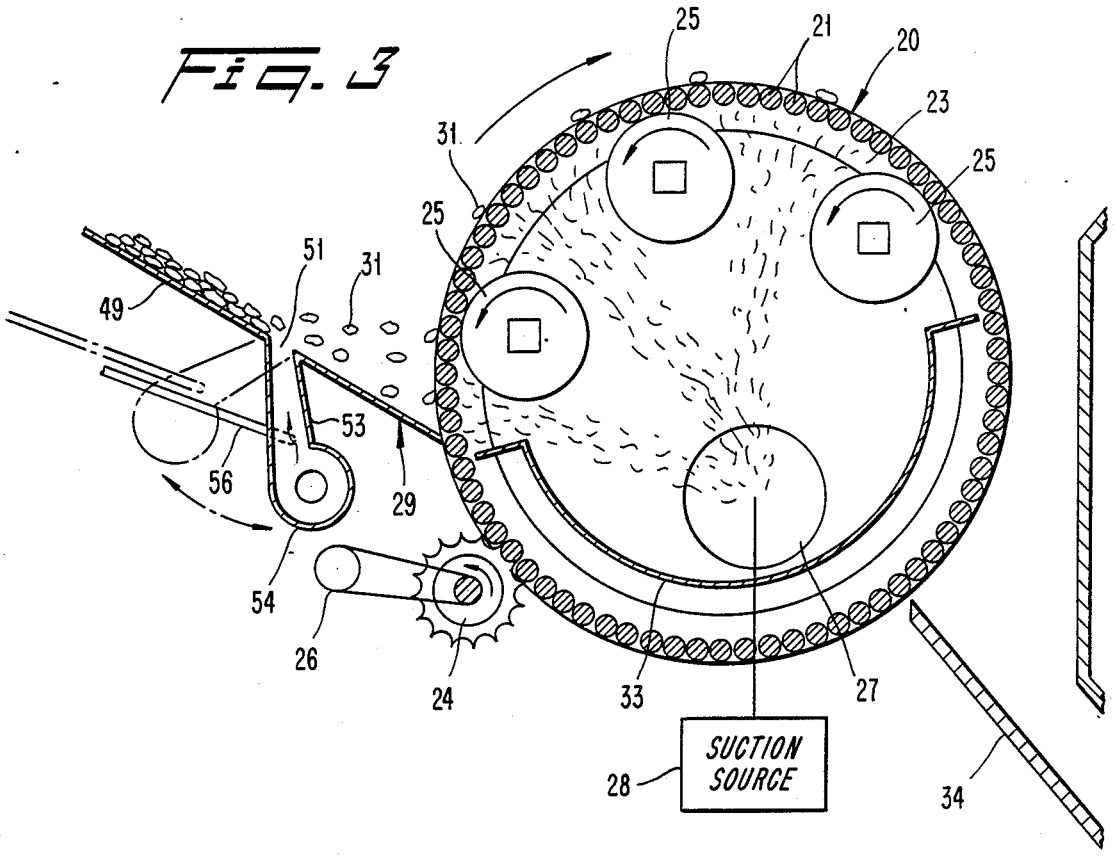
FIG. 3 is a cross-sectional view of a third embodiment of an apparatus according to the present invention, including a slotted, inclined feed apron and adjustable air source arrangement for separating the locks of seed cotton.

According to a further embodiment of the present invention as shown in FIG. 3, the feeding arrangement 29 includes an inclined feed apron 49 having a first side for receiving the seed cotton 31 and for directing the seed cotton 31 to the cage rollers 21. The seed cotton 31 can be fed to the feed apron 49 directly from an extractor-feeder (not shown) or alternatively, from some type of storage apparatus (not shown).

The inclined feed apron 49 has at least one slot 51 that extends over a substantial portion of the width of the feed apron 49 and preferably, over the entire width of the feed apron 49. An adjustable air nozzle 53 is associated with the slot 51 in the feed apron 49 and extends over the entire width of the slot 51. A suitable air source 54 is connected to the air nozzle 53 for directing an air stream from a second side of the feed apron 49 through the slot 51 in the feed apron 49. The seed cotton 31 is deposited on the inclined feed apron 49 and the seed cotton 31 falls down the feed apron 49 towards the cage rollers 21 as a result of the inclined nature of the feed apron 49. As the seed cotton 31 passes over the slot 51, the air stream from the air nozzle 53 lifts the seed cotton 31 off the feed apron 49 and thereby separates the seed cotton into individual locks. The individual locks of seed cotton are then directed to the cage roller apparatus 20 by the air stream and fiber fractions are removed from the individual locks. In that way, seed cotton that would otherwise reach the cage roller apparatus 20 in a bunched-up manner as a result of friction and differences in density among the individual locks, is uniformly distributed on the cage roller apparatus 20 in individual locks.

The air nozzle 53 is adjustable from the full line configuration shown in FIG. 3 to the dotted line configuration. The air nozzle 53 can be adjusted between the two positions by an arm 56 that is attached to the air nozzle 53. Any other type of suitable arrangement could be utilized for adjusting the position of the air nozzle 53. The nozzle 53 can be adapted to continually and automatically move between the full line position and the dotted line position during operation of the apparatus. Alternatively, the air nozzle can be adapted to be adjusted from one fixed position to another fixed position according to the discretion of the operator.

It should be understood that in the feeding arrangement 29 illustrated in FIG. 3, more than one slot 51 may be provided, if desired, in order to increase the amount of air flowing through the feed apron 49. In such a case, each slot 51 could have an adjustable air nozzle 53 associated therewith.

Figure 4:
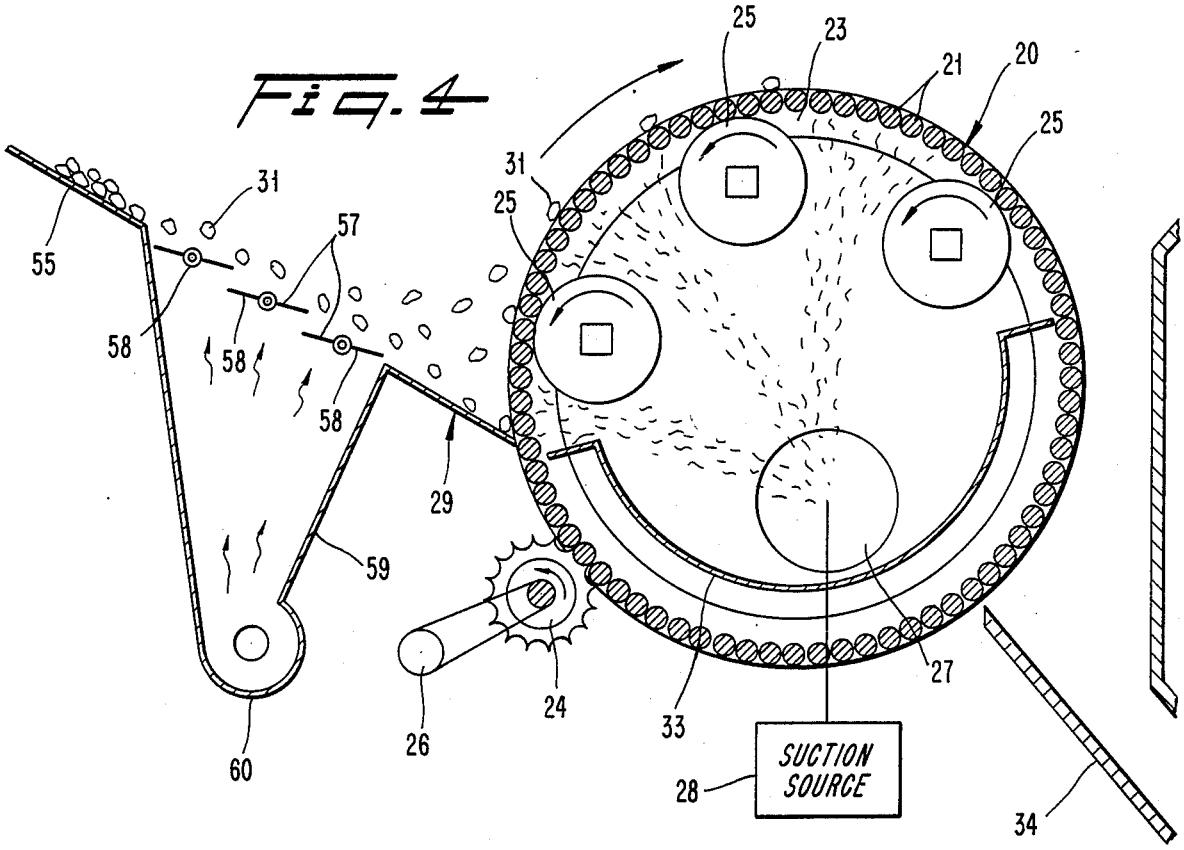
FIG. 4 is a cross-sectional view of a fourth embodiment of an apparatus according to the present invention, including an air source and inclined feed apron with adjustable louvers arrangement for separating the locks of seed cotton.

Referring now to FIG. 4, a fourth embodiment of the feeding arrangement 29 includes an inclined feed apron 55 having a first side that receives the seed cotton 31 and directs the seed cotton to the cage rollers 21. A plurality of adjustable louvers 57 are located along the feed apron 55. A suitable air source 60 is connected to a duct 59 for feeding a low volume stream of air into the duct 59. The duct 59 extends over the entire portion of the feed apron 55 having the adjustable louvers 57.

The low volume stream of air from the air source 60 passes through the adjustable louvers 57 from the second side of the feed apron 55 and thereby lifts the seed cotton off the surface of the feed apron 55 so that the seed cotton is separated into individual locks. The individual locks of seed cotton are then directed to the cage rollers 21 by the air stream and fiber fractions are removed from the individual locks. As was noted above with respect to the FIG. 3 embodiment, seed cotton that would normally reach the cage rollers 21 in a bunched-up manner because of friction and differences in density among the individual locks, reaches the cage rollers 21 as individual locks and thus, is uniformly distributed on the cage rollers 21.

To elaborate further, when seed cotton is deposited on an inclined feed apron or slide surface, the fibers in one lock of seed cotton tend to become entangled with the fibers in other locks of seed cotton. The interengagement of the fibers in different locks of seed cotton results in part from the variations in density between the locks of seed cotton as well as frictional forces. By subjecting the bunched-up locks of seed cotton to the arrangements illustrated in FIGS. 3 and 4, the entangled fibers become separated so that the seed cotton can arrive at the cage rollers in the form of individual locks. The FIGS. 3 and 4 embodiments not only separate the entangled fibers but also prevent the fibers of different locks of seed cotton from becoming entangled in the first place.

The louvers 57 illustrated in the FIG. 4 embodiment are adjustable so that the amount of air passing through the spaces between the louvers 57 can be varied. The louvers 57 can be adapted to be freely and automatically adjusted by the force of the air stream so that an air stream of higher velocity will open the louvers 57 more widely. In that respect, the louvers can be mounted on bearing-lined axles 58 that permit the louvers 57 to freely pivot on the axles 58. Alternatively, the louvers 57 can be adapted to be adjusted from one position to another by an operator and fixed in a particular position until the operator changes the position of the louvers 57.

Figure 5:
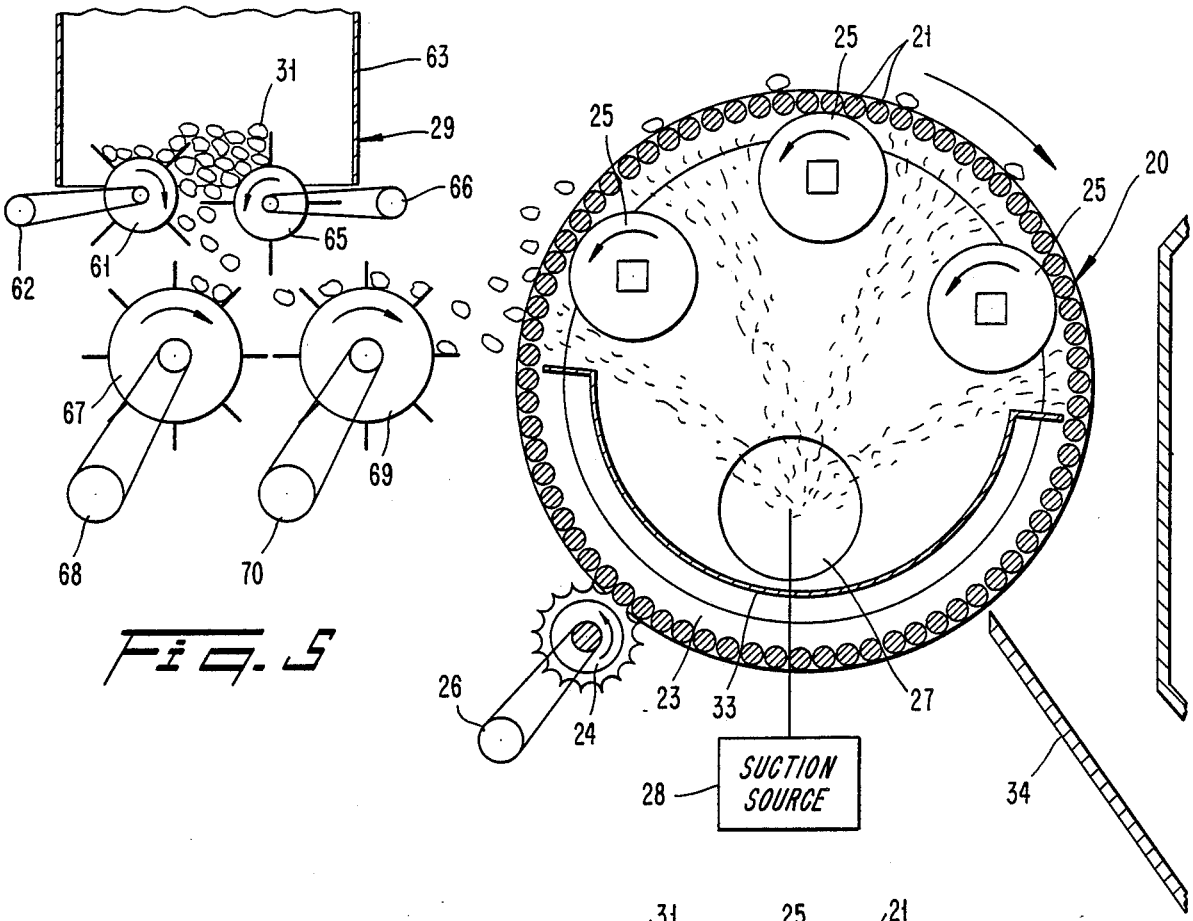
FIG. 5 is a cross-sectional view of a fifth embodiment of an apparatus according to the present invention, including an arrangement for feeding seed cotton directly to the ginning surface of the cage roller apparatus without contacting any other surfaces.

FIG. 5 shows a fifth embodiment of the feeding arrangement 29 of the present invention. That embodiment includes a housing 63 for receiving seed cotton 31 from a seed cotton cleaner (not shown) or other suitable storage device (not shown). Two fluted rolls 61, 65 are provided near the bottom of the housing 63. The two fluted rolls 61, 65 are rotatably driven in opposite directions by suitable drive devices 62, 66 respectively. One of the fluted rolls 61 is rotatably driven in a clockwise direction while the other fluted roll 65 is rotatably driven in a counter-clockwise direction. The two fluted rolls 61, 65 control the feed rate of the seed cotton 31 and force the seed cotton 31 between the two fluted rolls 61, 65. The two fluted rolls 61, 65 are arranged substantially parallel to one another.

Two spiked tooth cylinders 67, 69 are arranged parallel to one another and are positioned below the two fluted rolls 61, 65. The spiked tooth cylinders 67, 69 are rotatably driven in the same direction by suitable drive devices 68, 70 respectively. In the embodiment illustrated in FIG. 5, the two spiked tooth cylinders 67, 69 are rotatably driven in the clockwise direction. The two spiked tooth cylinders are positioned such that seed cotton fed from between the two fluted rolls 61, 65 will fall onto the spiked tooth cylinder 67 positioned farthest from the cage rollers 21 and will then be carried over to the spiked tooth cylinder 69 positioned closest to the cage rollers 21 by the rotation of the one spiked tooth cylinder 67. The seed cotton will then be fed directly to the cage rollers 21 without contacting any other surface.

As was discussed above, in the prior art, seed cotton 31 is typically fed to a ginning apparatus by way of an inclined feed apron or some other slide surface. However, when seed cotton contacts such a surface, friction and variations in density between the individual locks of seed cotton causes the locks to touch one another so that the fibers in one lock of seed cotton become entangled with the fibers in other locks of seed cotton. As a result, the locks of seed cotton arrive at the ginning apparatus in bunches and as was noted at the outset, when the seed cotton reaches the ginning apparatus in bunches, only a portion of the seed cotton is subjected to the nipping and pulling action of the ginning apparatus.

Thus, the feeding arrangement 29 of the present invention as depicted in FIG. 5 overcomes that problem because the fluted rolls 61, 65 and the spiked tooth cylinders 67, 69 are arranged with respect to the cage rollers 21 of the ginning apparatus such that seed cotton is fed from the fluted rolls 61, 65 to the spiked tooth cylinders 67, 69 and directly from the spiked tooth cylinders 67, 69 to the cage rollers 21 of the ginning apparatus without contacting any surface that might cause the fibers of one lock to become entangled with the fibers in other locks.

The spiked tooth cylinders 67, 69 serve several important functions with respect to the feeding operation of the ginning apparatus. In particular, the spiked tooth cylinders 67, 69 separate the seed cotton 31 into individual locks, they direct the feeding of the seed cotton onto the cage rollers 21 and they provide multipoint loading of the seed cotton 31 onto the cage rollers 21. The spiked tooth cylinders 67, 69 are able to provide those advantageous functions as a result of the fact that the seed cotton 31 drops from the fluted rolls 61, 65 onto the one spiked tooth cylinder 67 and then is passed over to the other spiked tooth cylinder 69. As the seed cotton 31 is passed from the one spiked tooth cylinder 67 to the other spiked tooth cylinder 69, the seed cotton 31 is separated into individual locks and the individual locks are then uniformly distributed onto the cage rollers 21 to provide multipoint loading of the seed cotton onto the cage rollers 21.

Figure 5A:
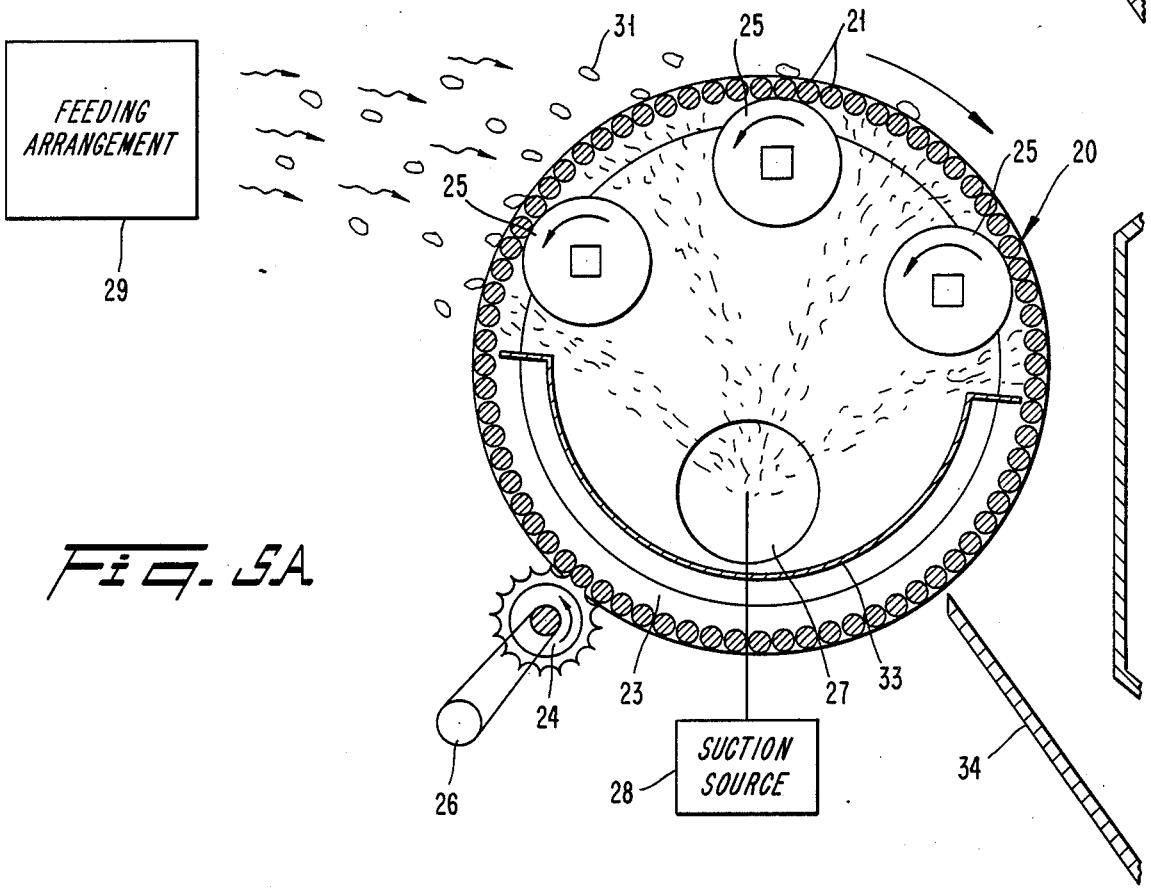
FIG. 5A is a cross-sectional view of a cage roller apparatus according to the present invention, including an illustration of the multipoint loading of the seed cotton on the cage roller apparatus.

The manner in which the above-described multipoint loading is carried out can be better understood with reference to FIG. 5A where only the specifics of the cage roller apparatus 20 are depicted. For convenience and illustrative purposes, the feeding arrangement 29 is shown as a box.

As seen in FIG. 5A, the seed cotton is directed from the feeding arrangement 29 towards the surface of the cage rollers 21 in such a manner that the seed cotton is spread out over the surface of the cage rollers 21. Some of the seed cotton will fall on the surface of the cage rollers 21 at a point before or adjacent the first nip roller while other locks of seed cotton will be distributed downstream from the first nipping position in the direction of rotation of the cage as illustrated in FIG. 5A. Thus, the multipoint loading of the seed cotton spreads the seed cotton across a large portion of the surface of the cage rollers in order to make more efficient use of the ginning surface of the ginning apparatus. Further, by spreading out the seed cotton on the surface of the ginning apparatus, use can be made of that portion of the ginning surface where ginning has already occurred. Thus, the multipoint loading of the seed cotton that is made possible through the feeding arrangement of the present invention is advantageous when compared to presently available feeding arrangements where the seed cotton is loaded onto the surface of the ginning apparatus at substantially the same point. Those types of feeding arrangements tend to reduce the potential efficiency of the ginning apparatus because the entire ginning surface is not used for ginning the seed cotton. Also, since the seed cotton is loaded at substantially the same point, seed cotton is actually deposited on top of other locks of seed cotton that have not been ginned or that have only partially been ginned.

It is to be noted that the feeding arrangements 29 depicted in FIGS. 3 and 4 are also adapted to provide multipoint loading of the seed cotton on the surface of the cage rollers 21 in the manner illustrated in FIGS. 5A. In that regard, the stream of air that passes through the slot 51 or the louvers 57 tends to lift the seed cotton off the surface of the inclined feed apron and direct the seed cotton toward the surface of the cage rollers. The seed cotton is, therefore, spread out over the surface of the cage rollers 21 in a manner that results in multipoint loading of the seed cotton. Thus, the same advantages noted above with respect to the FIG. 5 embodiment are also attributable to the FIG. 3 and FIG. 4 embodiments.

In order to maximize the multipoint loading ability of the feeding arrangements 29 depicted in FIGS. 3–5, it is to be understood that the feeding arrangements 29 could be positioned in a manner relative to the ginning apparatus 20 that is slightly different from that shown in FIGS. 3–5.

In the embodiment of the present invention illustrated in FIG. 5, the diameter of the fluted rolls 61, 65 may be approximately five and one-quarter inches while the center-to-center spacing between the fluted rolls 61, 65 may be approximately six inches. The fluted rolls 61, 65 may be adapted to be driven at a variable speed ranging between ten revolutions per minute and fifty revolutions per minute while the spiked tooth cylinders 67, 69 may be driven at approximately five hundred and ninety revolutions per minute. The diameter of the spiked tooth cylinders 67, 69 may be about eight and one-half inches and the center-to-center spacing between the cylinders 67, 69 may be approximately eleven and one-quarter inches. The length of the spikes on the spiked tooth cylinders 67, 69 may be about one and one-quarter inches in length and the vertical center-to-center spacing between the fluted rolls 61, 65 and the spiked tooth cylinders 67, 69 can be approximately eight inches. Finally, the horizontal center-to-center spacing between the left most spiked-tooth cylinder 67 and the right most fluted roll 65 may be about three inches.

Figure 6:
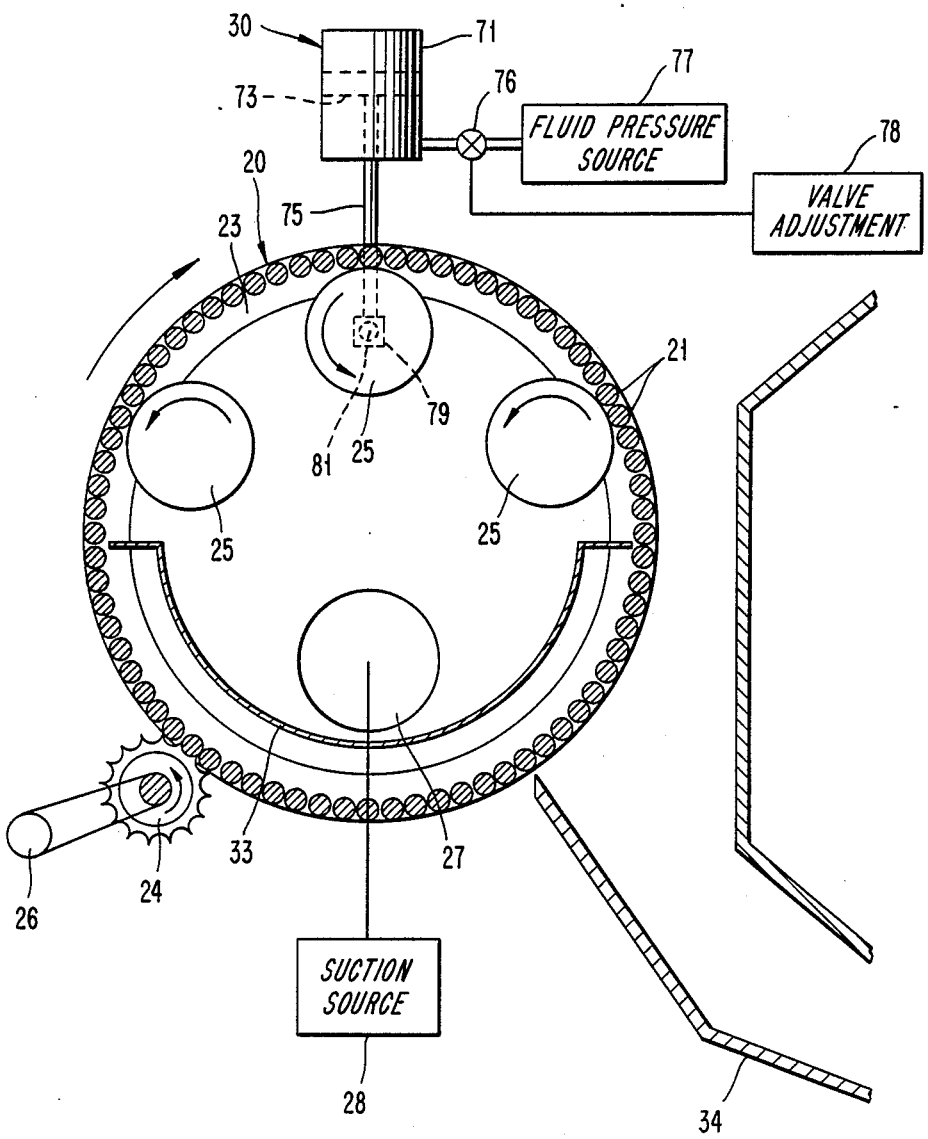
FIG. 6 is a cross-sectional view of a sixth embodiment of an apparatus according to the present invention, including an arrangement for varying the force applied by at least one of the nip rollers to the cage rollers.

In FIG. 6, an arrangement 30 for varying the force applied by at least one of the nip rollers 25 to the cage rollers 21 is shown. The arrangement 30 includes a cylinder 71 having a piston 73 and a piston rod 75 associated therewith. A fluid pressure source 77 supplies fluid under pressure to the interior of the cylinder 71 to move the piston 73 and the piston rod 75 in either direction parallel to the piston rod 75. The end of the piston rod 75 located away from the cylinder 71 is attached to a bearing 79 located on both ends of the nip roller shaft 81. Alternatively, the end of the piston rod 75 located away from the cylinder 71 can be attached to both ends of the nip roller shaft 81. It is to be understood that as an alternative, a separate piston and cylinder arrangement 30 could be attached to each end of the nip roller shaft 81 or to each bearing located on opposite ends of the nip roller shaft 81.

A suitable valve 76 may be provided for regulating the pressure of the fluid supplied from the fluid pressure source 77 to the cylinder 71. The regulating valve 76 can be attached to any suitable arrangement 78 for either automatically or manually adjusting the valve 76. The fluid pressure source 77 can be either a hydraulic pressure source or a pneumatic pressure source.

The fluid supplied under pressure from the fluid pressure source 77 flows into the cylinder 71 to thereby move the piston 73 within the cylinder 71. The amount of fluid pressure supplied from the fluid pressure source 77 can be varied so that the force applied by the nip roller 25 to the cage rollers 21 can be varied. The ability of the nip roller 25 to apply a variable force to the cage rollers 21 is advantageous because the inventors of the present invention have found that the application of varying amounts of force to the cage rollers 21 results in the removal of different length fibers from the seed cotton. More particularly, the inventors have discovered that more cotton can be removed from the seed cotton through the application of a greater nip roller force while longer fibers can be removed from the seed cotton when less force is applied by the nip roller 25 to the cage rollers 21. The removal of longer fibers can be desirable because the longer fibers are usually of higher quality. Thus, the use of the arrangement 30 depicted in FIG. 6 permits the removal of higher quality fibers from the seed cotton. Also, the use of the variable force arrangement 30 shown in FIG. 6 in conjunction with each of the nip rollers 25 would permit the amount of lint cotton removed at each of the nipping points to be varied.

In addition to permitting a variable force to be applied by the nip rollers 25 to the cage rollers 21, the arrangement 30 shown in FIG. 6 also provides several other desirable advantages. During operation of the ginning apparatus, fibers of cotton are pulled from the locks of seed cotton. The arrangement of the nip rollers 25 relative to the cage rollers 21 in combination with the fact that the surface speed of the nip rollers 25 is approximately twice the surface speed of the cage can cause the long fibers to build-up and form an elongated roll of fibers in front of the nip rollers 25 (i.e., on the left side of the nip rollers 25 as seen in FIG. 6). Continued build-up of the cotton fibers can result in the development of excessive forces between the nip rollers 25 and the cage rollers 21. However, when such a build-up of cotton fibers does occur, the arrangement 30 will permit the nip roller 25 to move away from the cage rollers 21 so that the clump or roll of cotton fibers can pass between the nip roller 25 and the cage rollers 21. In that way, excessive forces do not develop between the cage rollers 21 and the nip roller 25.

A further advantage associated with the arrangement 30 depicted in FIG. 6 is that when the build-up of cotton fibers does occur, the nip roller 25 can maintain the same nipping force. Hence, even if a build-up of cotton tends to force the nip roller 25 away from the surface of the cage rollers 21, the arrangement 30 depicted in FIG. 6 permits the force applied by the nip roller 25 to be maintained at a constant amount. Thus, the arrangement 30 according to the present invention possesses certain advantages not associated with an arrangement where the nip rollers 25 are rigidly mounted with respect to the cage rollers 21 or an arrangement that permits the position of the nip rollers 25 to be varied from one position to another but which fixes the position of the nip rollers after their position has been adjusted.

Although the arrangement shown in FIG. 6 depicts a variable force arrangement 30 attached to only one of the nip rollers 25, it should be understood that more than one of the nip rollers 25 and possibly all of the nip rollers 25 could have a variable force arrangement 30 attached thereto. In that way, the nipping force at each one of the nipping points could be varied. Further, it is to be understood that the arrangement 30 shown in FIG. 6 for varying the force applied by the nip roller 25 to the cage rollers 21 could be utilized in conjunction with any of the arrangements shown in FIGS. 1–5 for breaking-up and separating the seed cotton into individual locks. The use of the variable force nip roller 25 depicted in FIG. 6 in conjunction with any of the feeding arrangements shown in FIGS. 1–5 would provide a ginning apparatus that is capable of achieving results that are better than the results achieved through the separate use of the feeding arrangements 29 and the variable force nip roller arrangement 30.

To explain, the feeding arrangements 29 shown in FIGS. 1–5 help ensure that the seed cotton is separated into individual locks and uniformly distributed on the surface of the cage rollers in a single layer. The variable force nip roller arrangement 30 illustrated in FIG. 6, on the other hand, permits the selective removal of cotton fibers of different length from the seed cotton. The combination of the variable force nip roller arrangement 30 and any of the feeding arrangements 29 shown in FIGS. 1–5 results in a ginning apparatus that is capable of removing a large amount of cotton fiber as a result of the fact that the seed cotton is more evenly distributed over the surface of the cage rollers. Further, the apparatus can be operated to effect higher selectivity in terms of fiber length by appropriate adjustment of the force applied by the nip roller to the cage rollers. Accordingly, the length, and, therefore, the quality of the ginned fibers can be selected by the operator.

Figure 7:
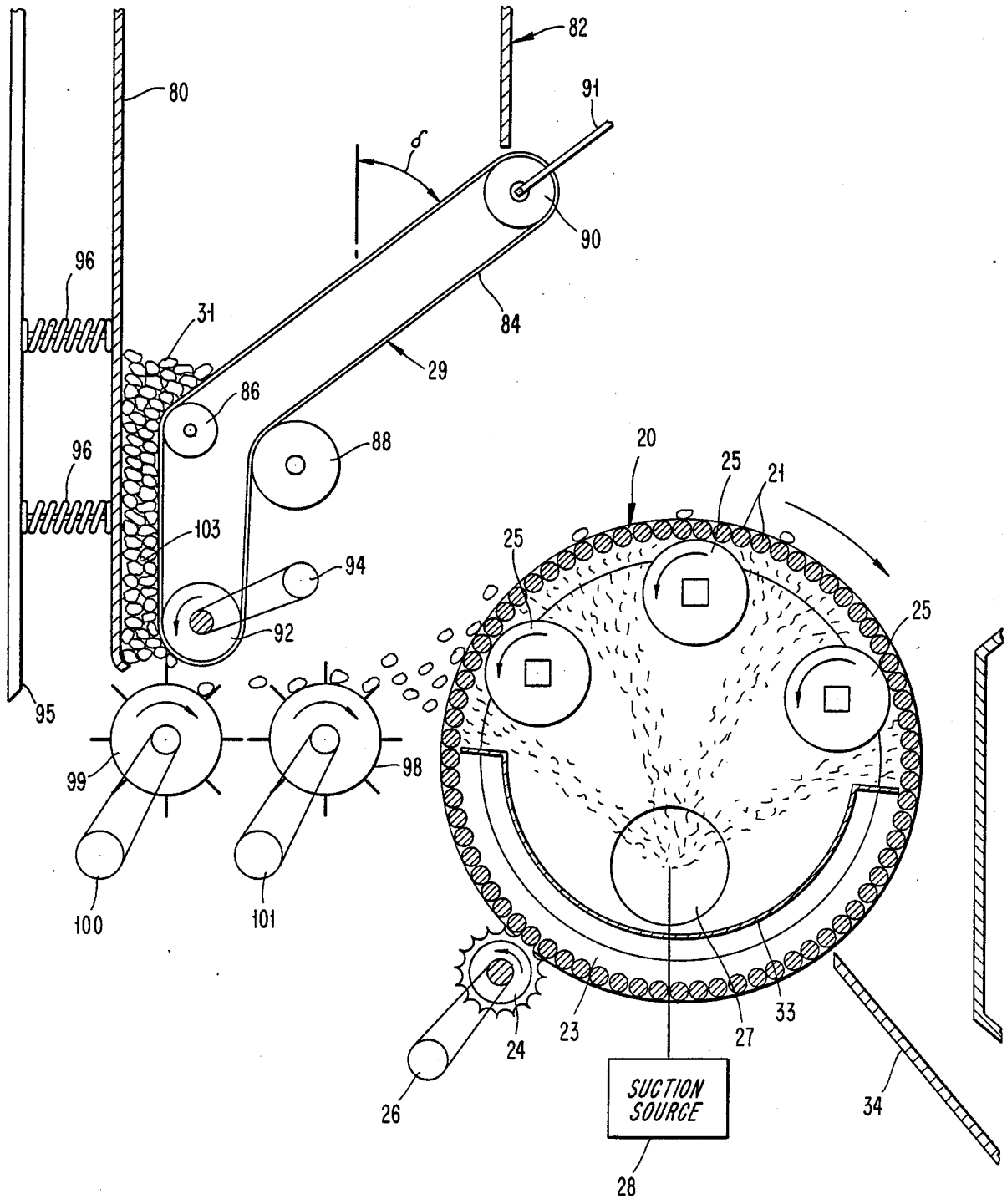
FIG. 7 is a cross-sectional view of a seventh embodiment of an apparatus according to the present invention, including an arrangement for pulling separate locks of seed cotton from a hopper bin and for directing the separated locks to a cage roller apparatus without contacting any other surfaces.

In FIG. 7, an additional embodiment of the feeding arrangement 29 includes a hopper bin 82 and a high friction conveyor belt 84. The high friction conveyor belt 84 is wrapped around two idler rolls 86, 88, an adjustable belt tension roller 90 and a variable speed power driven roller 92. The adjustable belt tensioner roller 90 is attached to an arm 91 that can be adjusted for adjusting the position of the roller 90 to thereby vary the tension in the high friction belt 84. The roller 92 is connected to a variable speed driving apparatus 94 that imparts a variable speed to the roller 92. The variable speed driving apparatus 94 can be adjusted automatically or by an operator in order to vary the speed of the roller 92. It can be readily seen that the roller 92 drives the high friction conveyor belt 84 in the counterclockwise direction.

One side wall 80 of the hopper bin 82 is biased in the direction toward the high friction belt 84. In the embodiment illustrated, two springs 96 are positioned between the back face of the movable side wall 80 and the front face of a fixed wall 95. The springs 96 apply a force to the side wall 80 that is dependent upon the spring constant of the springs 96. A different force can be maintained against the side wall 80 by utilizing springs 96 having a different spring constant.

Two spike toothed cylinders 98, 99 are positioned below the feeding arrangement 29. The spiked tooth cylinders 98, 99 are rotatably driven in the same direction by suitable drive devices 100, 101 respectively.

As seed cotton 31 is fed into the upper part 102 of the hopper bin 82 from a seed cotton cleaner (not shown) or other suitable storage device (not shown), the high friction conveyor belt 84 forces the seed cotton downward toward the lower part 103 of the hopper bin 82. When the seed cotton reaches the lower part 103 of the hopper bin 82, the seed cotton is pressed between the high friction conveyor belt 84 and the spring biased side wall 80. To a certain extent, the seed cotton in the lower part 103 of the hopper bin 82 will be compacted as a result of the somewhat horizontal force applied by the spring biased side wall 80 and the somewhat vertical force applied by the counterclockwise movement of the high friction conveyor belt 84. When the seed cotton reaches the bottom of the hopper bin 82, the spiked tooth cylinder 99 positioned beneath the outlet of the hopper bin will tend to pull individual locks of seed cotton from the somewhat compacted mass of seed cotton. Thus, instead of the seed cotton falling onto the spiked tooth cylinder 99 in clumps or bunches as a result of being somewhat compacted, individual locks of seed cotton will be pulled and separated from the rest of the seed cotton in the hopper bin 82. The separated locks will then be transported to the adjacent spiked tooth cylinder 98 and finally, will be directed to the surface of the cage rollers 21.

It can be readily seen from FIG. 7 that the upper part 102 of the hopper bin 82 is larger than the lower part 103. It has been found desirable that the upper portion of the high friction conveyor belt 84 be inclined at an angle δ as illustrated in FIG. 7 of approximately thirty degrees.

It can be understood from the above discussion, that when an individual lock of seed cotton is pulled from the somewhat compacted mass of seed cotton in the lower part 103 of the hopper bin 82 by the spiked tooth cylinder 99, the continual conveying force of the high friction conveyor belt 82 will tend to force the somewhat compacted mass of seed cotton slightly lower to permit the spiked tooth cylinder 99 to pull another individual lock from the lower part 103 of the hopper bin 82. It is to be noted also that the arrangement depicted in FIG. 6 for varying the force applied by the nip roller 25 to the cage roller 21 could be used in combination with the FIG. 7 feeding arrangement 29.

The embodiment illustrated in FIG. 7 is somewhat similar to the embodiment described above with respect to FIG. 5 in that in the FIG. 7 embodiment, the feeding arrangement 29 is designed so that once the locks of seed cotton are pulled from the hopper bin 82 and separated from the remaining locks of seed cotton by the spiked tooth cylinder 99, the separated locks of seed cotton are fed directly to the other spiked tooth cylinder 98 and then are fed directly to the cage rollers 21 without contacting any surface other than the spiked tooth cylinders 98, 99. As a consequence, the locks do not touch one another and thus, as noted previously, the fibers of different locks of seed cotton do not become entangled.

The embodiment illustrated in FIG. 7 is also similar to the embodiment shown in FIG. 5 in that the rotating spiked tooth cylinder provides multipoint loading of the seed cotton onto the surface of the cage rollers 21. Thus, the same advantages discussed above in conjunction with FIG. 5A are also realized through the arrangement shown in FIG. 7.

Figure 8:
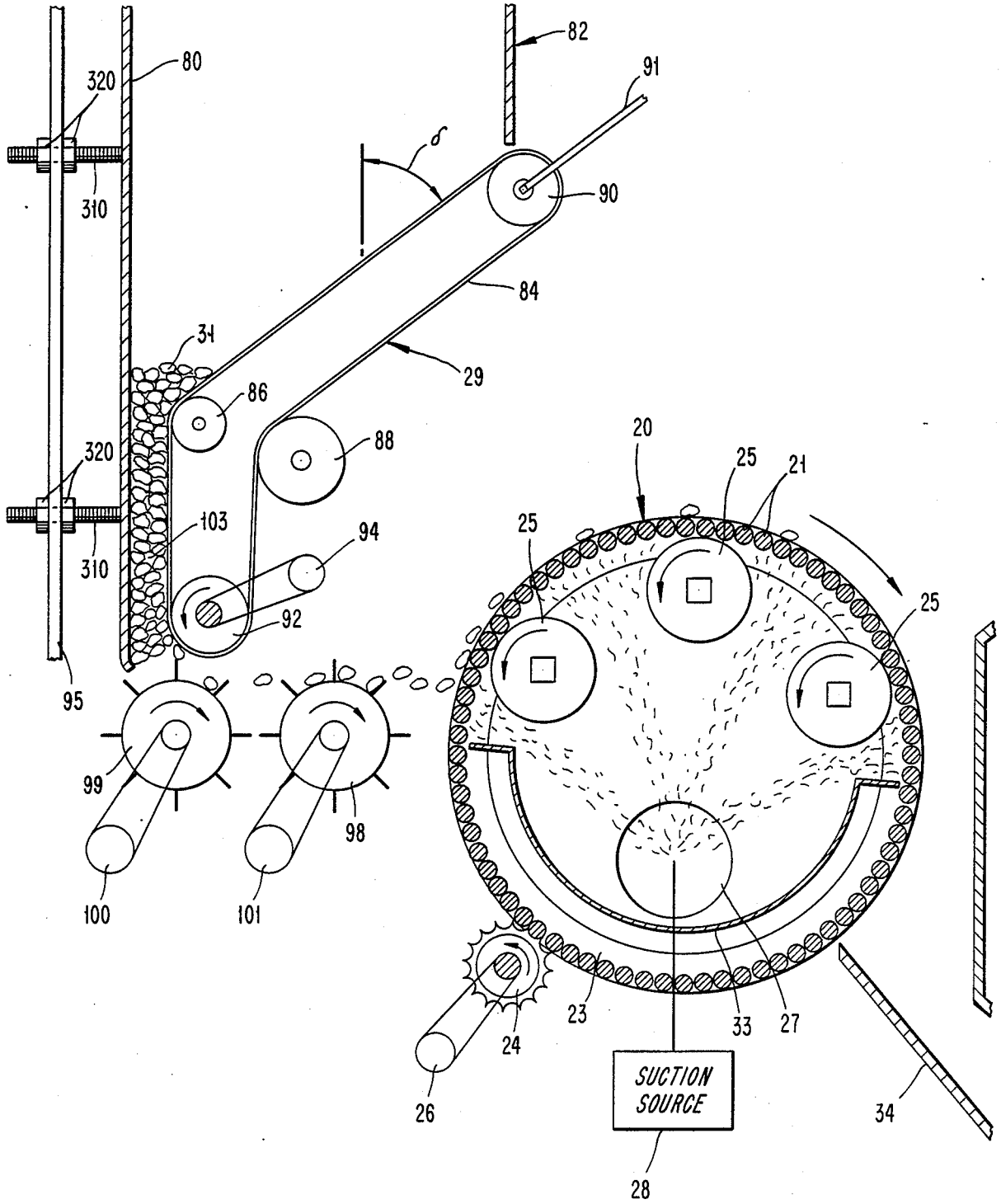
FIG. 8 is a cross-sectional view of a further embodiment of an apparatus according to the present invention that is similar to the embodiment shown in FIG. 7.

Another embodiment of the present invention is shown in FIG. 8. The embodiment shown in FIG. 8 is similar in all respects to the embodiment illustrated in FIG. 7 except with respect to the specific structure of the side wall 80. Accordingly, the description of those features of the embodiment illustrated in FIG. 8 that have already been described with reference to FIG. 7 will not be repeated.

As shown in FIG. 8, the side wall 80 has two exteriorly threaded rods 310 that are attached to and extend from the back face of the side wall 80. The exteriorly threaded rods 310 pass freely through holes in the fixed wall 95 so that the side wall 80 can move relative to the fixed wall 95. A plurality of interiorly threaded nuts 320 are provided for fixing the position of the side wall 80 relative to the fixed wall 95. The interior threads on the nuts 320 engage the exterior threads on the rod 310 so that the position of the nuts 320 along the exteriorly threaded rods 310 can be adjusted. As shown in FIG. 8, the nuts 320 are positioned on both sides of the fixed wall 95. The arrangement depicted in FIG. 8 permits the position of the side wall 80 to be selectively adjusted and fixed by changing the position of the nuts 320 along the rods 310. In that way, the amount of pressure applied by the side wall 80 to the seed cotton in the hopper bin can be selectively varied Also, the size of the opening at the bottom of the hopper bin 82 can be varied by adjusting the position of the side wall 80 relative to the high friction conveyor belt 84.

Although FIG. 8 illustrates one type of arrangement for permitting the position of the side wall 80 to be adjusted and fixed, other arrangements could be employed for effecting the same result. For example, a motor driven or a fluid operated arrangement could be attached to the side wall 80.

Figure 9:
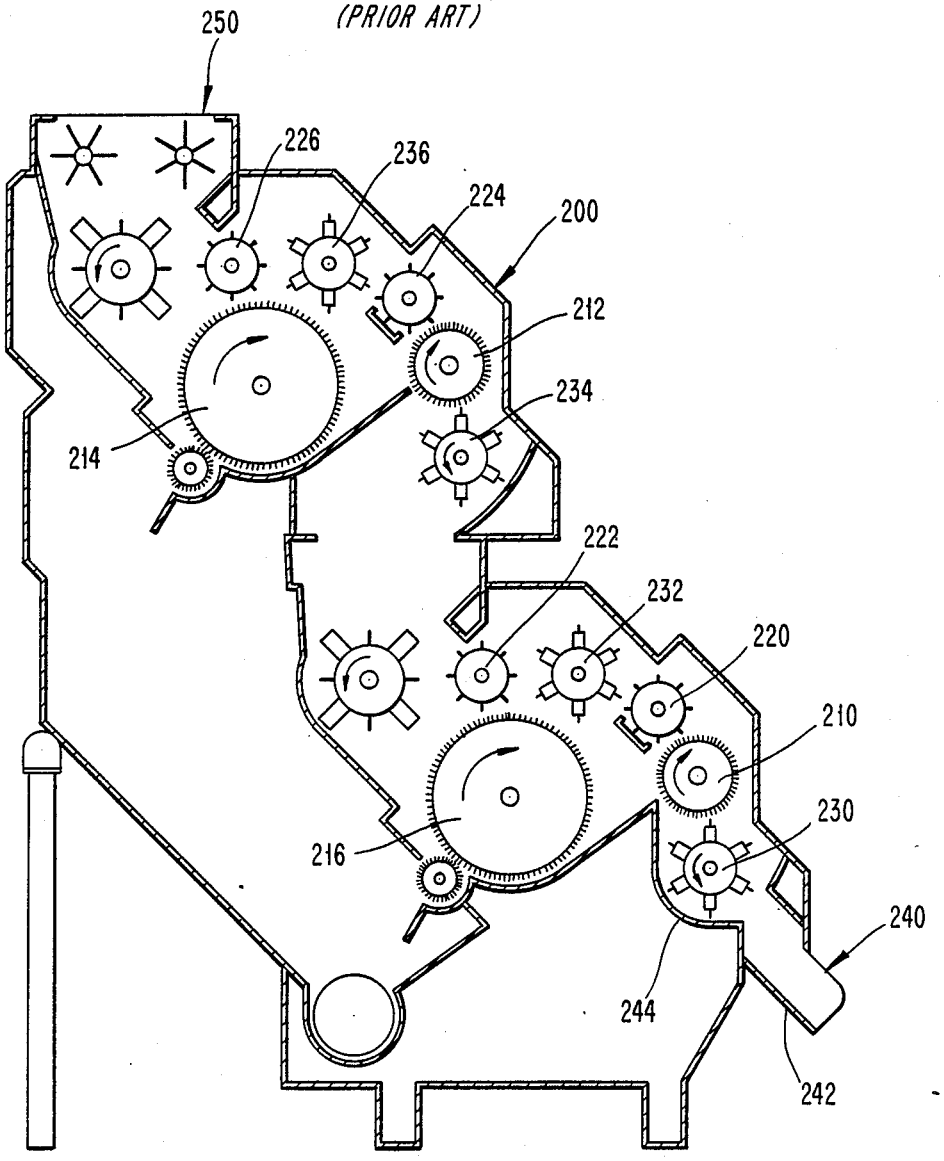
Fig. 9 (PRIOR ART)
FIG. 9 is a cross-sectional view of a prior art cleaning and feeding apparatus showing the arrangement of the doffer brush relative to the other portions of the feeding apparatus.

In FIG. 9, a prior art cleaning and feeding apparatus 200 is illustrated. The prior art cleaning and feeding apparatus 200 includes a plurality of cleaning saw cylinders 210, 212, 214, 216, a plurality of stripper rollers 220, 222, 224, 226, a plurality of doffer brushes 230, 232, 234, 236, and other various rollers and cylinders for conveying the seed through the cleaning and feeding apparatus 200. The specific details of the operation of the prior art cleaning and feeding apparatus 200 will be omitted here as they are believed to be well known by those skilled in the art.

Of particular concern here is the arrangement of the doffer brush 230 that is located closest to the outlet end 240 of the cleaning and feeding arrangement 200 relative to the housing 244 that encloses the doffer brush 230 and the slide 242 that directs the seed cotton to the ginning apparatus (not shown). Seed cotton is fed into the opening 250 in the top portion of the apparatus 200 and through operation of the various cylinders and rollers located in the apparatus 200, the seed cotton eventually works its way down to the cleaning saw cylinder 210 and the doffer brush 230 located at the bottom of the apparatus 200. When the seed cotton is brushed off or pulled from the cleaning saw cylinder 210 by the doffer brush 230, the seed cotton contacts the interior surface of the portion 244 of the housing that encloses the doffer brush 230. Further, in order to direct the seed cotton to the ginning apparatus (not shown), the seed cotton is fed along a slide 242.

As was mentioned above, certain drawbacks can result when the seed cotton contacts an inclined feed apron or some type of slide surface. To reiterate, when seed cotton contacts such a surface, the friction between the seed cotton and the surface in combination with the variations in density between the individual locks of seed cotton causes the locks to touch one another so that the fibers in one lock of seed cotton become entangled with the fibers in other locks of seed cotton. As a consequence, the seed cotton arrives at the ginning apparatus in bunches or clumps.

The prior art apparatus depicted in FIG. 9 is susceptible to the foregoing problem as a result of the fact that after the seed cotton is brushed off or pulled from the cleaning saw cylinder 210 by the doffer brush 230, the seed cotton contacts the interior surface of the portion 244 of the housing that encloses the doffer brush 230. Also, the seed cotton contacts and slides along the slide surface 242 as it is fed to the ginning apparatus (not shown). Therefore, it is highly likely that the seed cotton will reach the ginning apparatus in bunches or clumps, which, as mentioned at the beginning of the application, prevents the ginning apparatus from ginning those locks of seed cotton that are piled on top of other locks of seed cotton.

Figure 10:
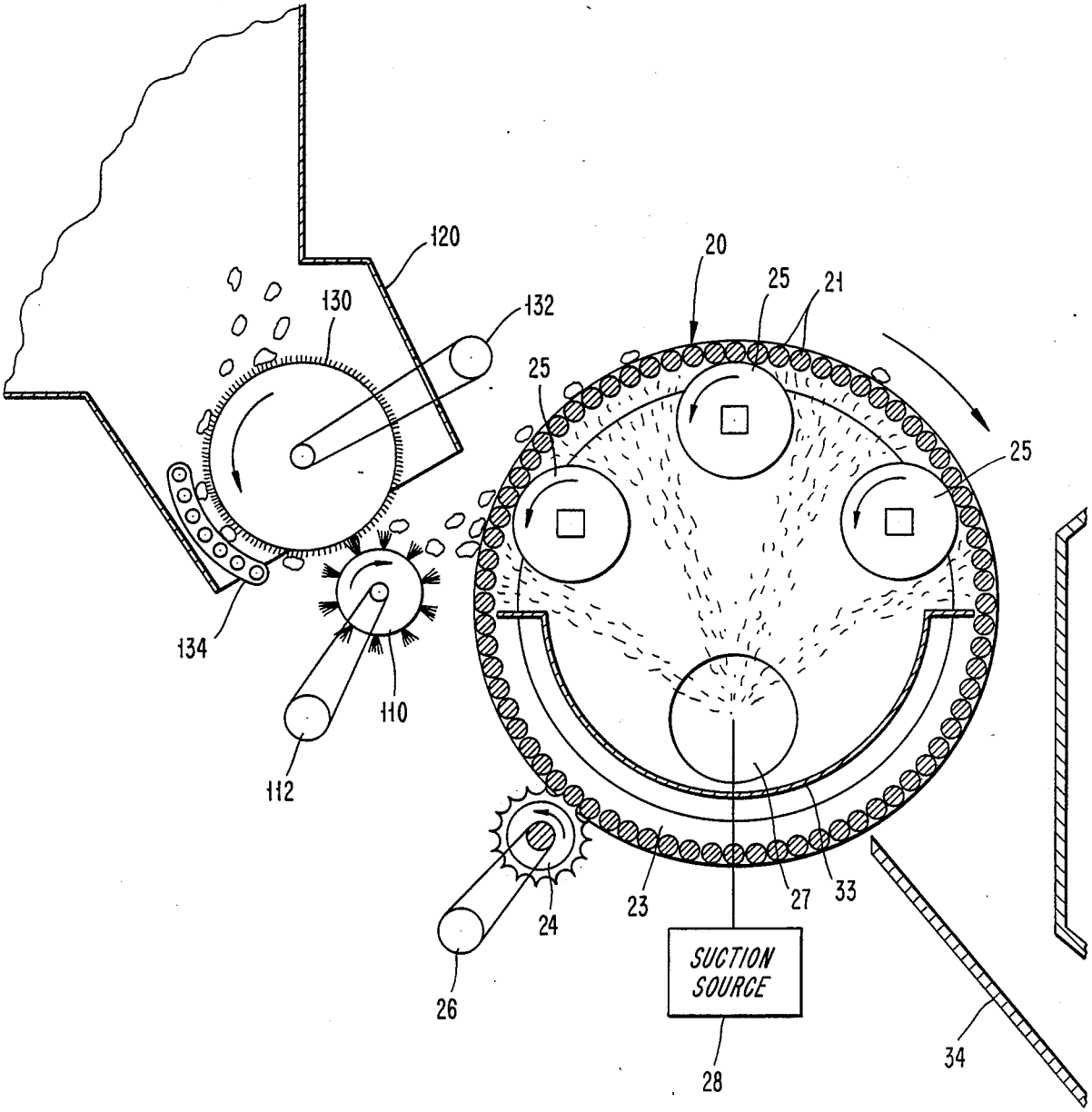
FIG. 10 is a cross-sectional view of another embodiment of an apparatus according to the present invention, including a doffer brush that brushes locks of seed cotton from the exterior surface of a cleaning saw cylinder and feeds the seed cotton directly to the surface of the cage rollers.

FIG. 10 illustrates an additional embodiment of the feeding arrangement according to the present invention that is designed to overcome the foregoing drawbacks. The arrangement includes a housing or hopper 120 into which seed cotton can be fed. The seed cotton can be fed into the housing 120 from a cleaning apparatus (not shown) or some type of suitable storage device (not shown). The housing 120 can have a plurality of rollers and cylinders located therein as shown in FIG. 9 for cleaning the seed cotton and feeding the seed cotton to the bottom of the housing 120. Alternatively, other arrangements of rollers, cylinders and the like can be located in the housing 120 for cleaning and feeding the seed cotton.

Located at the bottom of the housing 120 is a cleaning saw cylinder 130 that is rotatably driven in the counterclockwise direction by a suitable driving device 132. Positioned below the cleaning saw cylinder is a doffer brush 110 that is rotatably driven in the clockwise direction by a suitable driving device 112. A cleaning grid 134 is positioned between the wall of the housing 120 and the cleaning saw cylinder 130 in such a manner that seed cotton that is held to the exterior surface of the cleaning saw cylinder 130 will pass through the cleaning grid 134 prior to being brushed off by the doffer brush 110. The cleaning saw cylinder 130 and the doffer brush 110 are rotatably driven in such a manner that the surface speed of the doffer brush is substantially greater than the surface speed of the cleaning saw cylinder 130.

The cleaning saw cylinder 130 is configured such that when a lock of seed cotton comes into contact with the exterior surface of the cleaning saw cylinder 130, the lock of seed cotton is aggressively and tenaciously held to the exterior surface of the cleaning saw cylinder 130. The doffer brush 110 is positioned in such a manner that as it rotates, the brushes extending from the exterior surface of the doffer brush 110 can brush off or pull the seed cotton from the exterior surface of the cleaning saw cylinder 130. The faster surface speed of the doffer brush 110 helps enable the seed cotton to be pulled from the cleaning saw cylinder 130. In the arrangement depicted in FIG. 10, the seed cotton that is brushed off or pulled from the exterior surface of the cleaning saw cylinder 130 is then directed towards the surface of the cage rollers 21.

The arrangement shown in FIG. 10 overcomes the aforementioned drawbacks associated with feeding arrangements that permit the seed cotton to contact an inclined feed apron or other slide surface prior to reaching the ginning apparatus. It can be readily seen that the arrangement according to the present invention as illustrated in FIG. 10 permits individual locks of seed cotton to be brushed off or pulled from the cleaning saw cylinder 130 and thereafter, uniformly deposited on the cage rollers 21. Once the seed cotton is brushed off or pulled from the exterior surface of the cleaning saw cylinder 130, the seed cotton is fed directly to the cage rollers 21 and is prevented from contacting any surface that might cause the locks of seed cotton to touch one another. As a result, the fibers in different locks of seed cotton do not become entangled and thus, the locks of seed cotton do not bunch up and form clumps.

The doffer brush 110 can be rotated in such a manner as to result in a brush tip speed of approximately thirty five hundred feet per minute. Further, it is to be noted that the doffer brush 110 could be used in conjunction with the variable force nip roller 25 depicted in FIG. 6 in order to achieve the same advantageous results noted above.

The arrangement shown in FIG. 10 is also desirable in that the rotating doffer brush directs the seed cotton towards the surface of the cage rollers in such a manner that multipoint loading of the seed cotton on the surface of the cage rollers occurs. Thus, the advantages discussed above in connection with FIG. 5A are realized by the arrangement shown in FIG. 10.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes and equivalents which fall within the spirit and scope of the present invention as defined in the claims be embraced thereby.

What is claimed is:

1. An apparatus for removing a fiber fraction from seed cotton comprising:

a plurality of freely rotatable cage rollers arranged substantially parallel to one another, said plurality of cage rollers being rotatably driven in a continuous path, said continuous path having a first side for receiving the seed cotton and a second side opposite said first side;

at least one rotatable nip roller having an outer peripheral surface that is positioned in abutting relation to the cage rollers on the second side of the continuous path to thereby apply a force to the cage rollers; and means for separating the seed cotton into individual locks before the seed cotton is fed onto the first side of the continuous path, said means for separating the seed cotton including means for providing an air stream for impinging on the seed cotton, said air stream having sufficient force to separate the individual locks of the seed cotton.

2. The apparatus according to claim 1, wherein said means for separating the seed cotton into individual locks includes a first duct through which the air streams flows and a second duct through which the seed cotton is fed, said first duct being connected to said means for providing an air stream, said second duct intersecting said first duct and said first duct having means positioned at a point along its length prior to the intersection of the first and second ducts for increasing the velocity and decreasing the pressure of the air stream in the first duct and as the air stream exits the first duct so that seed cotton exiting from the second duct is separated into individual locks by the air stream of increased velocity and decreased pressure prior to being fed onto the first side of the continuous path.

3. The apparatus according to claim 2, wherein said means for increasing the velocity and decreasing the pressure of the air stream includes a first portion of the first duct having a rectangular cross-section of constant size and a second portion of the first duct having a rectangular cross-section, said second portion having an inclined side so that the cross-sectional area of said second portion continually narrows in a direction away from said first portion, said second portion being positioned between said first portion and the point of intersection of said first and second ducts.

4. The apparatus according to claim 2, and further comprising a third duct extending from exit points of said first and second ducts toward the cage rollers for directing the separated locks of seed cotton onto the first side of the continuous path.

5. The apparatus according to claim 2, and further comprising a plurality of fluted rolls positioned in the second duct.

6. The apparatus according to claim 1, wherein said means for separating the seed cotton into individual locks includes an inclined feed apron having a first side for receiving the seed cotton and a second side opposite said first side, said feed apron having a plurality of adjustable louvers through which the air stream from the second side of the feed apron flows so that seed cotton passing along the feed apron will be separated into individual locks prior to reaching the first side of the continuous path as a result of the air stream flowing through the louvers on the feed apron and so that multipoint loading of the seed cotton on the first side of the continuous path will occur.

7. The apparatus according to claim 1, wherein said means for separating the seed cotton into individual locks includes an inclined feed apron having a first side for receiving the seed cotton and a second side opposite said first side, said feed apron having at least one slot extending along at least a substantial portion of the width of the feed apron through which the air stream from the second side of the feed apron flows so that seed cotton passing along the feed apron will be separated into individual locks prior to reaching the first side of the continuous path as a result of the air stream flowing through the at least one slot in the feed apron and so that multipoint loading of the seed cotton on the first side of the continuous path will occur, said air stream being fed through an adjustable air nozzle.

8. The apparatus according to claim 1, and further comprising means attached to said at least one nip roller for varying the force applied by the nip roller to the cage rollers, said at least one nip roller being rotatable about a centrally located shaft that has two ends, said means for varying the force applied by the at least one nip roller to the cage rollers including at least one fluid operated cylinder, a fluid source connected to the cylinder and means for regulating the pressure of the fluid supplied from the fluid source to the cylinder, said cylinder including a piston slidably movable in the cylinder and a piston rod connected to the piston, said piston rod being attached to both ends of the shaft of the at least one nip roller.

9. An apparatus for removing a fiber fraction from seed cotton comprising:

a plurality of freely rotatable cage rollers arranged substantially parallel to one another, said plurality of cage rollers being rotatably driven in a continuous path, said continuous path having a first side for receiving the seed cotton and a second side opposite said first side;

at least one rotatable nip roller having an outer peripheral surface that is positioned in abutting relation to the cage rollers on the second side of the continuous path to thereby apply a force to the cage rollers; and means for separating the seed cotton into individual locks before the seed cotton is fed onto the first side of the continuous path, said means for separating the seed cotton including two rotatably driven fluted rolls and two rotatably driven spiked tooth cylinders positioned below said fluted rolls, said spiked tooth cylinders being arranged to separate the seed cotton into individual locks, said fluted rolls and said spiked tooth cylinders being arranged with respect to the first side of the continuous path such that seed cotton is fed from the fluted rolls to the spiked tooth cylinders and directly to the first side of the continuous path without contacting any surface other than the fluted rolls and the spiked tooth cylinders and such that multipoint loading of the seed cotton onto the first side of the continuous path occurs.

10. The apparatus according to claim 9, wherein said two fluted rolls are rotatably driven in opposite directions and said two spiked tooth cylinders are rotatably driven in the same direction.

11. The apparatus according to claim 9, and further comprising means attached to said at least one nip roller for varying the force applied by the nip roller to the cage rollers, said at least one nip roller being rotatable about a centrally located shaft that has two ends, said means for varying the force applied by the at least one nip roller to the cage rollers including at least one fluid operated cylinder, a fluid source connected to the cylinder and means for regulating the pressure of the fluid supplied from the fluid source to the cylinder, said cylinder including a piston slidably movable in the cylinder and a piston rod connected to the piston, said piston rod being attached to both ends of the shaft of the at least one nip roller.

12. An apparatus for removing a fiber fraction from seed cotton comprising:

a plurality of rotatable cage rollers arranged substantially parallel to one another, said plurality of cage rollers being rotatably driven in a continuous path, said continuous path having a first side for receiving the seed cotton and a second side opposite said first side;

at least one nip roller having an outer peripheral surface that is positioned in abutting relation to the cage rollers on the second side of the continuous path to thereby apply a force to the cage rollers; and means for separating the seed cotton into individual locks before the seed cotton is fed onto the first side of the continuous path, said means for separating the seed cotton including a hopper bin and at least one spiked tooth cylinder positioned below said hopper bin and adjacent a lower part of said hopper bin, said hopper bin and said at least one spiked tooth cylinder being arranged with respect to the first side of the continuous path such that individual locks of seed cotton can be pulled from the lower part of the hopper bin by the at least one spiked tooth cylinder and can be conveyed directly to the first side of the continuous path without contacting any surface other than a spiked tooth cylinder, whereby multipoint loading of the seed cotton onto the first side of the continuous path occurs.

13. The apparatus according to claim 12, wherein two spiked tooth cylinders that are rotatably driven in the same direction are positioned below said hopper bin and adjacent a lower part of said hopper bin, said hopper bin and said two spiked tooth cylinders being arranged with respect to the first side of the continuous path such that individual locks of seed cotton can be pulled from the lower part of the hopper bin by one of the spiked tooth cylinders, can be conveyed to the other spiked tooth cylinder and can be conveyed directly to the first side of the continuous path without contacting any surface other than the spiked tooth cylinders.

14. The apparatus according to claim 12, wherein said hopper bin includes means for conveying the seed cotton from an upper part of the hopper bin to the lower part of the hopper bin and a side wall positioned in opposing relation to said means for conveying, said side wall and said means for conveying causing the seed cotton to be slightly compacted in the lower part of the hopper bin.

15. The apparatus according to claim 14, wherein said means for conveying is a high friction conveyor belt and wherein said hopper bin includes means for spring biasing said side wall in opposing relation to said high friction conveyor belt.

16. The apparatus according to claim 14, wherein said means for conveying is a high friction conveyor belt and said hopper bin includes means for permitting the position of the side wall to be selectively adjusted and fixed relative to said conveyor belt so that the amount of pressure applied by the side wall to the seed cotton in the hopper bin can be selectively varied.

17. The apparatus according to claim 12, and further comprising means attached to said at least one nip roller for varying the force applied by the nip roller to the cage rollers, said at least one nip roller being rotatable about a centrally located shaft that has two ends, said means for varying the force applied by the at least one nip roller to the cage rollers including at least one fluid operated cylinder, a fluid source connected to the cylinder and means for regulating the pressure of the fluid supplied from the fluid source to the cylinder, said cylinder including a piston slidably movable in the cylinder and a piston rod connected to the piston, said piston rod being attached to both ends of the shaft of the at least one nip roller.

18. An apparatus for removing a fiber fraction from seed cotton comprising:

a plurality of rotatable cage rollers arranged substantially parallel to one another, said plurality of cage rollers being rotatably driven in a continuous path, said continuous path having a first side for receiving the seed cotton and a second side opposite said first side;

at least one nip roller having an outer peripheral surface that is positioned in abutting relation to the cage rollers on the second side of the continuous path to thereby apply a force to the cage rollers, said at least one nip roller being rotatable about a centrally located shaft that has two ends; and means attached to said least one nip roller for varying the force applied by the at least one nip roller to the cage rollers, said means including at least one fluid operated cylinder attached to the at least one nip roller, a fluid source connected to the cylinder and means for regulating the pressure of the fluid supplied to said cylinder to vary the force applied by the at least one nip roller to the cage rollers.

19. The apparatus according to claim 18, and further comprising means for separating the seed cotton into individual locks before the seed cotton is fed onto the first side of the continuous path, said means for separating the seed cotton including means for providing an air stream for impinging on the seed cotton, said air stream having sufficient force to separate the individual locks of seed cotton.

20. The apparatus according to claim 19, wherein said means for separating the seed cotton into individual locks includes a first duct through which the air stream flows and a second duct through which the seed cotton is fed, said first duct being connected to said means for providing an air stream, said second duct intersecting the first duct and said first duct having means positioned at a point along its length prior to the intersection of the first and second ducts for increasing the velocity and decreasing the pressure of the air stream as the air stream exits the first duct so that seed cotton exiting from the second duct is separated into individual locks by the air stream of increased velocity and decreased pressure prior to being fed onto the first side of the continuous path.

21. The apparatus according to claim 20, wherein said means for increasing the velocity and decreasing the pressure of the air stream includes a first portion of the first duct having a rectangular cross-section and a second portion of the first duct having a rectangular cross-section, said second portion having an inclined side so that the cross-sectional area of the second portion continually narrows in a direction away from said first portion, said second portion being positioned between said first portion and the point of intersection of said first and second ducts.

22. The apparatus according to claim 21 and further comprising a third duct extending from exit points of said first and second ducts toward the cage rollers for directing the separated locks of seed cotton onto the first side of the continuous path.

23. The apparatus according to claim 20, and further comprising a plurality of fluted rolls positioned in the second duct.

24. The apparatus according to claim 19, wherein said means for separating the seed cotton into individual locks includes an inclined feed apron having a first side for receiving the seed cotton and a second side opposite said first side, said feed apron having a plurality of adjustable louvers through which the air stream from the second side of the feed apron flows so that seed cotton passing along the feed apron will be separated into individual locks prior to reaching the first side of the continuous path as a result of the air stream flowing through the louvers on the feed apron and so that multipoint loading of the seed cotton on the first side of the continuous path will occur.

25. The apparatus according to claim 19, wherein said means for separating the seed cotton into individual locks includes an inclined feed apron for directing the seed cotton to the first side of the continuous path, said feed apron having a first side for receiving the seed cotton and a second side opposite said first side, said feed apron having at least one slot extending along at least a substantial portion of the width of the feed apron through which the air stream from the second side flows so that seed cotton passing along the feed apron will be separated into individual locks prior to reaching the first side of the continuous path as a result of the air stream flowing through the at least one slot in the feed apron and so that multipoint loading of the seed cotton on the first side of the continuous path will occur, said air stream being fed through an adjustable air stream.

26. The apparatus according to claim 18, and further comprising means for separating the seed cotton into individual locks before the seed cotton is fed onto the first side of the continuous path, said means for separating the seed cotton into individual locks including two rotatably driven fluted rolls and two rotatably driven spiked tooth cylinders positioned below said fluted rolls, said fluted rolls and said spiked tooth cylinders being arranged with respect to the first side of the continuous path such that seed cotton is fed from the fluted rolls to the spiked tooth cylinders and directly to the first side of the continuous path without contacting any surface other than the fluted rolls and the spiked tooth cylinders, whereby multipoint loading of the seed cotton onto the first side of the continuous path occurs.

27. The apparatus according to claim 26, wherein said two fluted rolls are rotatably driven in opposite directions and said two spiked tooth cylinders, are rotatable, driven in the same direction.

28. The apparatus according to claim 18, wherein said at least one cylinder includes a piston slidably movable in the cylinder and a piston rod attached to the piston, said piston rod also being attached to both ends of the shaft of the at least one nip roller.

29. The apparatus according to claim 18, and further comprising means for separating the seed cotton into individual locks before the seed cotton is fed onto the first side of the continuous path, said means for separating the seed cotton including a hopper bin and at least one spiked tooth cylinder positioned below said hopper bin and adjacent a lower part of the hopper bin, said hopper bin and said at least one spiked tooth cylinder being arranged with respect to each other and with respect to the first side of the continuous path such that individual locks of seed cotton can be pulled from the lower part of the hopper bin by the at least one spiked tooth cylinder and can be conveyed directly to the first side of the continuous path without contacting any surface other than a spiked tooth cylinder, whereby multipoint loading of the seed cotton onto the first side of the continuous path occurs.

30. The apparatus according to claim 29, wherein two spiked tooth cylinders that are rotatably driven in the same direction are positioned below said hopper bin and adjacent a lower part of said hopper bin, said hopper bin and said two spiked tooth cylinders being arranged with respect to the first side of the continuous path such that individual locks of seed cotton can be pulled from the lower part of the hopper bin by one of the spiked tooth cylinders, can be conveyed to the other spiked tooth cylinder and can be conveyed directly to the first side of the continuous path without contacting any surface other than spiked tooth cylinders.

31. The apparatus according to claim 29, wherein said hopper bin includes a side wall, a high friction conveyor belt and means for spring biasing said side wall in opposing relation to the conveyor belt for conveying the seed cotton to the lower part of the hopper bin and for slightly compressing the seed cotton in the lower part of the hopper bin.

32. The apparatus according to claim 29, wherein said hopper bin includes a high friction conveyor belt, a side wall positioned in opposing relation to the conveyor belt and means for permitting the position of the side wall to be adjusted and fixed relative to the high friction conveyor belt so that the amount of pressure applied by the sidewall to the seed cotton in the hopper bin can be selectively varied.

33. An apparatus for removing a fiber fraction from seed cotton comprising:

a plurality of freely rotatable cage rollers arranged substantially parallel to one another, said plurality of cage rollers being rotatably driven in a continuous path, said continuous path having a first side for receiving the seed cotton and a second side opposite said first side;

at least one rotatable nip roller having an outer peripheral surface that is positioned in abutting relation to the cage rollers on the second side of the continuous path to thereby apply a force to the cage rollers;

a rotatable cylinder positioned adjacent said plurality of cage rollers, said cylinder having an exterior surface that is adapted to aggressively hold seed cotton thereto; and rotatable means positioned adjacent said rotatable cylinder for brushing off and pulling seed cotton from the exterior surface of the rotatable cylinder, for feeding the seed cotton that is brushed off and pulled from the exterior surface of the rotatable cylinder directly to the first surface of the continuous path without contacting any surface other than the rotatable means and for providing multipoint loading of the seed cotton onto the first side of the continuous path.

34. The apparatus according to claim 33, wherein said rotatable cylinder is a cleaning saw cylinder and said rotatable means is a doffer brush said cleaning saw cylinder and said doffer brush being rotatable in opposite directions.

35. The apparatus according to claim 33, and further comprising means attached to at least one nip roller for varying the force applied by the nip roller to the cage rollers, said at least one nip roller being rotatable about a centrally located shaft that has two ends, said means for varying the force applied by the at least one nip roller to the cage rollers including at least one fluid operated cylinder, a fluid source connected to the cylinder and means for regulating the pressure of the fluid supplied from the fluid source to the cylinder, said cylinder including a piston slidably movable in the cylinder and a piston rod connected to the piston, said piston rod being attached to both ends of the shaft of the at least one nip roller.

36. A method for processing seed cotton comprising the steps of:

directing an air stream into a first duct;

feeding seed cotton into a second duct that intersects the first duct;

increasing the velocity and decreasing the pressure of the air stream in the first duct as the air stream exits the first duct;

directing the seed cotton into the path of the air stream of increased velocity and decreased pressure to separate the seed cotton into individual locks;

conveying the individual locks to a cage roller apparatus for removing a fiber fraction from the seed cotton; and removing a fiber fraction from the seed cotton through operation of the cage roller apparatus.

37. The method in accordance with claim 36, and further comprising the step of controlling the feed rate of the seed cotton in the second duct.

38. A method for processing seed cotton comprising the steps of:

feeding seed cotton onto a first side of an inclined feed apron that directs the seed cotton to a cage roller apparatus for removing a fiber fraction from the seed cotton;

directing an air stream through adjustable louvers on the feed apron from a second side of the feed apron, said second side of the feed apron being opposite to said first side;

passing the seed cotton over the adjustable louvers on the feed apron to thereby separate the seed cotton into individual locks as a result of the air stream flowing through the adjustable louvers;

directing the separated locks of seed cotton to the cage roller apparatus; and removing a fiber fraction from the seed cotton through operation of the cage roller apparatus.

39. The method in accordance with claim 38, and further comprising the step of loading the seed cotton onto the first side of the continuous path in such a manner as to achieve multipoint loading of the seed cotton.

40. A method for processing seed cotton comprising the steps of:

feeding seed cotton onto a first side of an inclined feed apron that directs the seed cotton to a cage roller apparatus for removing a fiber fraction from the seed cotton;

directing an air stream through at least one slot in the feed apron from a second side of the feed apron, said second side of the feed apron being opposite to said first side and said slot in the feed apron extending over at least: a substantial portion of the width of the feed apron;

passing the seed cotton over the at least one slot in the feed apron to thereby separate the seed cotton into individual locks as a result of the air stream flowing through the at least one slot;

directing the separated locks of seed cotton to the cage roller apparatus; and removing a fiber fraction from the seed cotton through operation of the cage roller apparatus.

41. The method in accordance with claim 40, wherein the step of directing an air stream through at least one slot in the feed apron includes the step of angularly adjusting the air stream.

42. The method in accordance with claim 40, and further comprising the step of loading the seed cotton onto the first side of the continuous path in such a manner as to achieve multipoint loading of the seed cotton.

43. A method for processing seed cotton comprising the steps of:

feeding seed cotton to two fluted rolls that rotate in opposite directions;

directing the seed cotton directly from the fluted rolls to two spiked tooth cylinders that rotate in the same direction;

directing the seed cotton directly from the spiked tooth cylinders to a cage roller apparatus without contacting any surface other than the spiked tooth cylinders; and removing a fiber fraction from the seed cotton through operation of the cage roller apparatus.

44. The method in accordance with claim 43, and further comprising the step of loading the seed cotton onto the first side of the continuous path in such a manner as to achieve multipoint loading of the seed cotton.

45. A method for processing seed cotton comprising the steps of:

feeding seed cotton into a hopper bin;

conveying the seed cotton to a lower part of the hopper bin and slightly compressing the seed cotton in the lower part of the hopper bin;

pulling separate locks of seed cotton from the lower part of the hopper bin with a spiked tooth cylinder;

directing the separated locks of seed cotton from the spiked tooth cylinder to a cage roller apparatus for removing a fiber fraction from the seed cotton without contacting any surface other than a spiked tooth cylinder; and removing a fiber fraction from the seed cotton through operation of the cage roller apparatus.

46. The method in accordance with claim 45, and further comprising the step of loading the seed cotton onto the first side of the continuous path in such a manner as to achieve multipoint loading of the seed cotton.

47. The method according to claim 45, wherein the step of conveying the seed cotton to a lower part of the hopper bin includes the step of conveying the seed cotton by a rotating high friction conveyor belt.

48. The method in accordance with claim 45, and further comprising the step of feeding the seed cotton from said spiked tooth cylinder to another spiked tooth cylinder and from said another spiked tooth cylinder directly to the cage roller apparatus without contacting any surface other than a spiked tooth cylinder.

49. A method for processing seed cotton comprising the steps of:

feeding seed cotton to a rotating cleaning saw cylinder that has an exterior surface that is adapted to aggressively hold seed cotton thereto;

brushing off seed cotton from the exterior surface of the rotating cleaning saw cylinder through use of a rotating doffer brush;

directing the seed cotton directly from the doffer brush to a cage roller apparatus without touching any surface other than the doffer brush; and removing a fiber fraction from the seed cotton through operation of the cage roller apparatus.

50. The method in accordance with claim 49, and further comprising the step of loading the seed cotton onto the first side of the continuous path in such a manner as to achieve multipoint loading of the seed cotton.

51. The method in accordance with claim 49, and further comprising the step of passing the seed cotton through a cleaning grid after the seed cotton has been fed onto the rotating cleaning saw cylinder but prior to when the seed cotton is brushed off the exterior surface of the cleaning saw cylinder by the rotating doffer brush.

52. A method for processing seed cotton in a cage roller apparatus that comprises a plurality of freely rotatable cage rollers arranged substantially parallel to one another and being rotatably driven in a continuous path, said continuous path having a first side for receiving the seed cotton and a second side opposite the first side, and at least one rotatable nip roller having an outer peripheral surface that is positioned in abutting relation to the cage rollers on the second side of the continuous path whereby a force is applied by the nip roller to the cage rollers, the method comprising the steps of:

feeding seed cotton onto the first side of the continuous path;

removing cotton fibers from the seed cotton through operation of the cage roller apparatus;

deciding to remove longer length cotton fibers from the seed cotton;

increasing the force between the cage rollers and the at least one nip roller in order to permit longer length cotton fibers to be removed from the seed cotton; and removing longer length cotton fibers from the seed cotton through operation of the cage roller apparatus.

* * * * *